US008950623B2

(12) United States Patent
Fleming

(10) Patent No.: US 8,950,623 B2
(45) Date of Patent: Feb. 10, 2015

(54) BEVERAGE CONTAINER LID THAT PROVIDES NATURAL DRINKING EXPERIENCE

(71) Applicant: Douglas H. Fleming, Bainbridge Island, WA (US)

(72) Inventor: Douglas H. Fleming, Bainbridge Island, WA (US)

(73) Assignee: Vaporpath, Inc., Bainbridge Island, WA (US)

( * ) Notice: Subject to any disclaimer, the term of this patent is extended or adjusted under 35 U.S.C. 154(b) by 106 days.

(21) Appl. No.: 13/797,858

(22) Filed: Mar. 12, 2013

(65) Prior Publication Data

US 2014/0042177 A1 Feb. 13, 2014

Related U.S. Application Data

(60) Provisional application No. 61/614,955, filed on Mar. 23, 2012.

(51) Int. Cl.
*B65D 43/02* (2006.01)
*B65D 47/06* (2006.01)

(52) U.S. Cl.
CPC ..... *B65D 43/02* (2013.01); *B65D 47/06* (2013.01); *B65D 43/0212* (2013.01); *Y10S 229/9061* (2013.01)
USPC ..... 220/713; 229/906.1

(58) Field of Classification Search
USPC ..... 220/713, 711, 703, 368, 521; 229/906.1
See application file for complete search history.

(56) References Cited

U.S. PATENT DOCUMENTS

| | | | |
|---|---|---|---|
| 2,358,600 | A | 9/1944 | Selten |
| 2,362,354 | A | 11/1944 | Clovis |
| 3,360,161 | A | 12/1967 | Smith |
| 3,400,855 | A | 9/1968 | Alexander |
| 3,868,043 | A | 2/1975 | Freemyer |
| 3,938,695 | A | 2/1976 | Ruff |
| 4,085,861 | A | 4/1978 | Ruff |
| 4,582,214 | A | 4/1986 | Dart et al. |
| 4,586,625 | A | 5/1986 | Garrett |

(Continued)

FOREIGN PATENT DOCUMENTS

| | | |
|---|---|---|
| CA | 2212228 | 7/2002 |
| CA | 2635219 | 7/2008 |

(Continued)

OTHER PUBLICATIONS

Louise Harpman & Scott Specht, Cabinet Magazine, Inventory/Peel, Pucker, Pinch, Puncture. Issue 19, Chance Fall 2005 (Sep. 2005). http://www.cabinetmagazine.org/issues/19/harpman.php (4 pages).

(Continued)

*Primary Examiner* — Fenn Mathew
*Assistant Examiner* — Robert Stodola
(74) *Attorney, Agent, or Firm* — R. Reams Goodloe, Jr.

(57) ABSTRACT

A drink-through lid for a beverage container. The lid provides a drink outlet that allows liquid to fill a drink well base, from which a consumer may sip a beverage similar to using a cup or mug. The base is sized and shaped to sealingly engage the opening of the beverage container. A hollow raised lip portion is provided, and it has an exterior portion extending upwardly from the base. An outer lip portion is provided, with interior portion sloping downwardly and inwardly. A drink well base may have a sloped floor extending upwardly from a peripheral side along the lower end portions. At least one drink outlet is provided.

73 Claims, 21 Drawing Sheets

(56) References Cited

U.S. PATENT DOCUMENTS

| | | | | |
|---|---|---|---|---|
| 4,589,569 | A | 5/1986 | Clements | |
| 4,609,124 | A | 9/1986 | Malloy | |
| 4,619,372 | A | 10/1986 | McFarland | |
| D287,919 | S | 1/1987 | Clements | |
| 4,768,674 | A | 9/1988 | Prescott | |
| D299,010 | S | 12/1988 | Wall | |
| 4,938,377 | A | 7/1990 | Jarvis | |
| 4,986,437 | A | 1/1991 | Farmer | |
| D345,673 | S | 4/1994 | Dark | |
| 5,370,258 | A | 12/1994 | Fair | |
| 5,398,843 | A | 3/1995 | Warden et al. | |
| 5,540,350 | A | 7/1996 | Lansky | |
| 5,542,670 | A | 8/1996 | Morano | |
| 5,820,016 | A | 10/1998 | Stropkay | |
| 5,897,019 | A | 4/1999 | Stropkay | |
| 6,003,711 | A | 12/1999 | Bilewitz | |
| 6,311,863 | B1 | 11/2001 | Fleming | |
| 6,375,033 | B1 | 4/2002 | Fleming | |
| 6,419,105 | B1 | 7/2002 | Bruce et al. | |
| 6,431,390 | B1 * | 8/2002 | Waller | 220/713 |
| 6,571,973 | B1 | 6/2003 | Tripsianes | |
| 6,644,490 | B2 | 11/2003 | Clarke | |
| D485,758 | S | 1/2004 | Clarke et al. | |
| 6,889,859 | B1 * | 5/2005 | Leon | 220/254.3 |
| 6,905,044 | B1 * | 6/2005 | Russo et al. | 220/719 |
| 7,100,790 | B2 | 9/2006 | Dark | |
| D540,165 | S | 4/2007 | Hollis et al. | |
| D546,180 | S | 7/2007 | Jowett et al. | |
| D547,605 | S | 7/2007 | Edelstein et al. | |
| 7,275,652 | B2 | 10/2007 | Morris et al. | |
| D592,056 | S | 5/2009 | Tedford, Jr. | |
| D592,952 | S | 5/2009 | Hundley et al. | |
| 7,591,393 | B2 | 9/2009 | Crudgington, Jr. | |
| D632,174 | S | 2/2011 | Charbonnet et al. | |
| D637,079 | S | 5/2011 | Brown et al. | |
| 7,959,029 | B2 | 6/2011 | Whitaker et al. | |
| D655,161 | S | 3/2012 | Daniel | |
| D690,988 | S | 10/2013 | Audette | |
| D691,847 | S | 10/2013 | Beckman | |
| 8,616,405 | B2 | 12/2013 | French et al. | |
| 8,733,583 | B2 * | 5/2014 | Bailey | 220/713 |
| 2002/0096530 | A1 * | 7/2002 | Waller | 220/713 |
| 2005/0087539 | A1 * | 4/2005 | Waller | 220/713 |
| 2005/0205588 | A1 * | 9/2005 | Pitts | 220/713 |
| 2007/0114236 | A1 | 5/2007 | Shiffer et al. | |
| 2008/0011762 | A1 | 1/2008 | Boone | |
| 2008/0061069 | A1 | 3/2008 | Edelstein et al. | |
| 2009/0266829 | A1 * | 10/2009 | Bailey | 220/713 |
| 2009/0294459 | A1 | 12/2009 | Hovsepian et al. | |
| 2009/0294460 | A1 | 12/2009 | Hovsepian et al. | |
| 2011/0114655 | A1 * | 5/2011 | Bailey | 220/713 |
| 2011/0266294 | A1 | 11/2011 | Charbonnet et al. | |
| 2012/0152968 | A1 * | 6/2012 | Bailey | 220/713 |
| 2014/0057023 | A1 * | 2/2014 | Sabga et al. | 426/77 |

FOREIGN PATENT DOCUMENTS

| | | | |
|---|---|---|---|
| GB | 2307633 | A | 6/1997 |
| WO | WO 96/39068 | | 12/1996 |
| WO | WO 2009/008587 | A1 | 1/2009 |
| WO | WO 2009/036426 | A2 | 3/2009 |

OTHER PUBLICATIONS

Nicola, Edible Geography, The Evolution of Lids. (May 9, 2011), http://www.ediblegeography.com/the-evolution-of-lids/ (7 pages).
Date unknown. Printed Nov. 15, 2013. Product Design (physical goods): Why is the Solo Traveler the dominant coffee cup lid? http://www.quora.com/Product-Design-physical-goods/Why-is-the-Solo-Traveler-the-dominant-coffee-cup-lid (7 pages).
US 6,003,721, 12/1999, Fleming (withdrawn).

* cited by examiner

BEVERAGE CONTAINER LID THAT PROVIDES NATURAL DRINKING EXPERIENCE

RELATED PATENT APPLICATIONS

This application claims priority from prior U.S. Provisional Patent Application Ser. No. 61/614,955, filed Mar. 23, 2012, entitled LID AND VAPOR DIRECTING BAFFLE FOR BEVERAGE CONTAINER, the disclosure of which is incorporated herein in its entirety, including the specification, drawing, and claims, by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure relates to lids for drinking cups, and more specifically, to lids for containers for beverages, and in some aspects, to containers for beverages having an aroma, such as coffee or tea,

BACKGROUND

Disposable beverage containers—which may be described herein as drinking cups or beverage cups—are ubiquitous for use in "on-the-go" consumption of liquids, particularly hot beverages such as coffee or tea. Disposable beverage cups often utilize a disposable lid to minimize splashing or spilling of the beverage from the container. Disposable lids most commonly used at this time provide a horizontally oriented drink opening on a top surface of a raised rim. Many of such designs allow a user to drink through the lid in a manner similar in many respects to drinking through a straw, or worse, in that it seems a limited amount of liquid is provided. Such shortcomings are exacerbated when vent openings are minimal or otherwise inadequately provided. Moreover, since such a drink opening is covered by the lips of the user while drinking, very little aroma from the beverage escapes to the user's nose.

Prior efforts to develop a disposable lid that would enable a user to drink naturally, as if drinking out of a cup or mug that does not have a lid thereon, have resulted in various undesired effects that have limited their utility. Thus, there remains a need to provide a lid design for a disposable beverage cup or container that is easy to use. It would be even more advantageous for such a lid to be provided in a disposable material. In would be additionally desirable if such a lid design were available that significantly enhances pleasurable drinking experience, in the manner of presentation of liquid to the user, and/or in the manner of providing aroma of the beverage to the user.

SUMMARY

A novel drink-through type beverage container lid has been developed, that in various embodiments, significantly enhance the pleasure of a user's beverage drinking experience as compared to various prior art lids and containers. The lid provides a drink outlet that allows liquid to fill a drink well base, and from which a consumer may sip a beverage similar to using a cup or mug. The lid has a base with a rim having a bottom edge, and an interior bead sealing portion. In an embodiment, the rim may be annular in shape. The base is sized and shaped to sealingly engage, via the interior bead sealing portion, an open end of a beverage cup. In many embodiments, a circular opening is provided in a beverage cup, which may be defined by a bead at the upper reaches thereof, and in such cases, the interior bead sealing portion sealingly engages the bead on the beverage cup. In an embodiment, when the drink-through lid is in use on a beverage container, the interior bead sealing portion may be centered with respect to a bead on the beverage cup. A hollow raised lip portion is provided in the lid, and it has an exterior portion extending upwardly from the base, an outer lip portion, and an interior portion sloping downwardly from the outer lip portion to lower end portions. In an embodiment, the interior portion of the raised hollow lip portion may slope inwardly from the outer lip portion.

A drink well base for containing liquid is provided. In an embodiment, the drink well base has a sloped floor extending upwardly from a peripheral side along the lower end portions. In an embodiment, the drink well base may be located above the bottom edge of the rim and below the outer lip portion. In an embodiment, the lowest portion of the floor of the drink well base may be located, vertically, above the center line of the interior bead sealing portion. In an embodiment, the lowest portion of the floor of the drink well base may be located at or near the vertical level of the center line of the interior bead sealing portion. In an embodiment, the lowest portion of the floor of the drink well base may be located below the center line of the interior bead sealing portion. In various embodiments, the drink well base may be located vertically at a level that is at about one-half inch (0.5") (1.27 cm) below the center line of the interior bead sealing portion, or higher. At least one drink outlet is provided. The at least one drink outlet may be defined by a first edgewall extending upward into the interior portion of the hollow raised lip portion, and by an elongated second edgewall extending along an outlet portion of the drink well base in proximity to the peripheral edge. In an embodiment, a portion of the at least one drink outlet may be oriented along a first surface extending from the elongated second edgewall at an angle alpha ($\alpha$) in the range of from about forty degrees (40°) to about ninety degrees (90°). In an embodiment, the first surface may be a planar surface. In an embodiment, a portion of the at least one drink outlet may be oriented along a second surface extending along the drink well base. In an embodiment, the second surface may be a planar surface. In an embodiment, the drink opening may be defined as if the first surface and the second surface are joined along a radiused curve. In an embodiment, a first planar surface and a second planar surface may be joined as if along a radiused curve. In an embodiment, an inwardly protruding shoulder may be provided from the interior portion of the hollow raised lip portion, and the drink opening may be defined by an opening cut along the inwardly protruding shoulder. In an embodiment, the inwardly protruding shoulder may be arcuate in shape, with an upwardly directed arching central portion.

In another embodiment, a drink-through lid as generally described above may be provided further including a downwardly extending wall extending transversely across the drink-through lid. In an embodiment, a v-shaped wall may be provided. In an embodiment, the downwardly extending wall may be parallel to the elongated second edgewall of the drink-through opening. In an embodiment, the downwardly extending wall may be provided in a continuous shaped surface from edge to edge, that is, downwardly through a valley which connects a first ridge and a second ridge of the wall.

In a further embodiment, a slit of length LS may be provided across the lid, as defined by first and second ends. In an embodiment, the slit may be further defined by a first edge and by a second edge in a downwardly extending wall. Such a slit may be utilized for locating a baffle therein. However, a drink-through lid including a slit may also be used on a beverage cup without a baffle inserted therein.

In an embodiment, a baffle may be provided for use with a drink-through lid having a slit therein. The baffle may be used for enhancing a beverage drinking experience by pumping and directing vapors toward the nose of a user. The baffle may be provided in a generally trapezoidal shaped configuration having a baffle height and varying widths complementary to the interior dimensions, including width and height, of a selected beverage cup. In an embodiment, the baffle may be provided with a slot defining a liquid passageway at the lower reaches thereof. In an embodiment, a baffle may also be provided with locking features to securely locate a baffle vertically with respect to the lid, and to assure close fitting engagement between the sides of the baffle and the inner wall of the beverage container, when the lid is snapped into place on the beverage container.

BRIEF DESCRIPTION OF THE DRAWING

The present invention(s) will be described by way of exemplary embodiments, using for illustration the accompanying drawing in which like reference numerals denote like elements, and in which.

Figure 1:
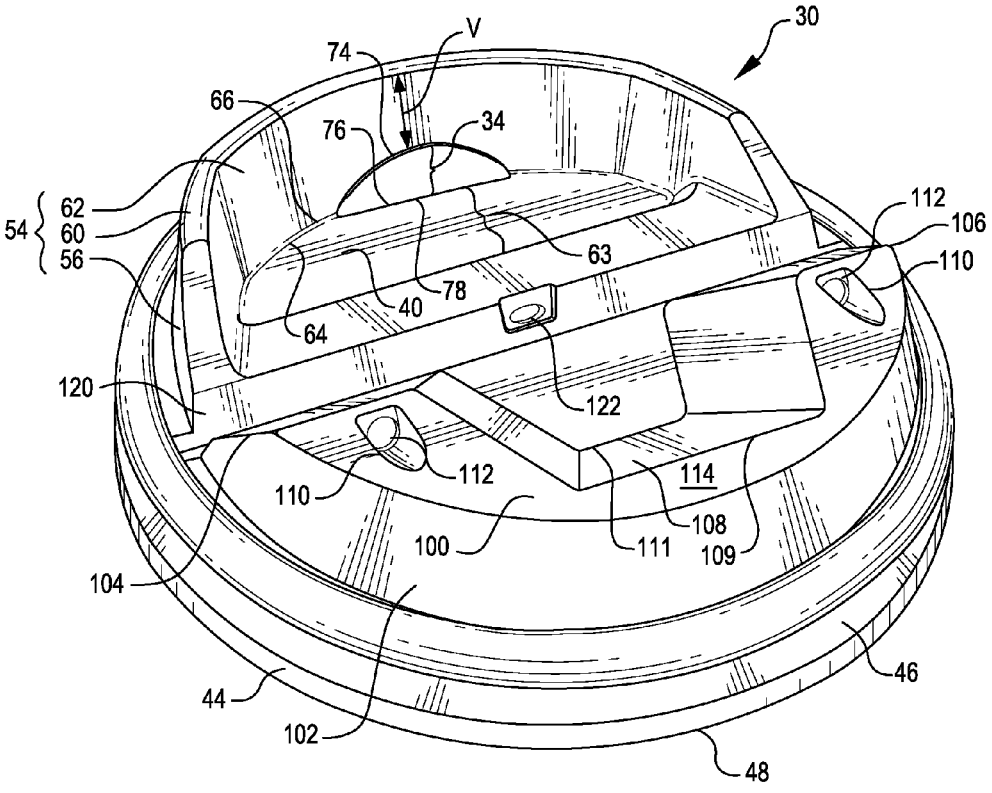
FIG. 1 is a perspective view of a drink-through lid for a cup, having a drink well base into which liquid emerges for consumption, and which also reveals an opening for passage of liquid to the drink well base, and in this embodiment, three vapor passageways.

The foregoing figures, being merely exemplary, contain various elements that may be present or omitted from a final configuration for a disposable lid, or of any baffle and lid for beverage container utilizing the principles taught herein, or that may be implemented in various embodiments described herein for such lids, baffles, and containers. Other variations in lid designs and in baffle designs may use slightly different mechanical structures, mechanical arrangements, liquid flow configurations, or vapor flow configurations, and yet employ the principles described herein and as generally depicted in the drawing figures provided. An attempt has been made to draw the figures in a way that illustrates at least those elements that are significant for an understanding of exemplary lid and baffle designs for beverage containers. Such details may be quite useful for providing a high quality improved beverage container lids for use in enhancing the drinking pleasure of users of the disposable lid designs and baffle designs taught herein.

It should be understood that various features may be utilized in accord with the teachings hereof, as may be useful in different embodiments as useful for various sizes and shapes of cups, lids, and baffles, depending upon the conditions of service, such as temperatures and vapor pressures of liquids being handled, and aroma content generated to vapors from such liquids, within the scope and coverage of the teachings herein as defined by the claims. Further, like features in various lid designs, whether or not including a slot for accommodation of a baffle, may be described using like reference numerals, or other like references, without further mention thereof.

DETAILED DESCRIPTION

Figure 2:
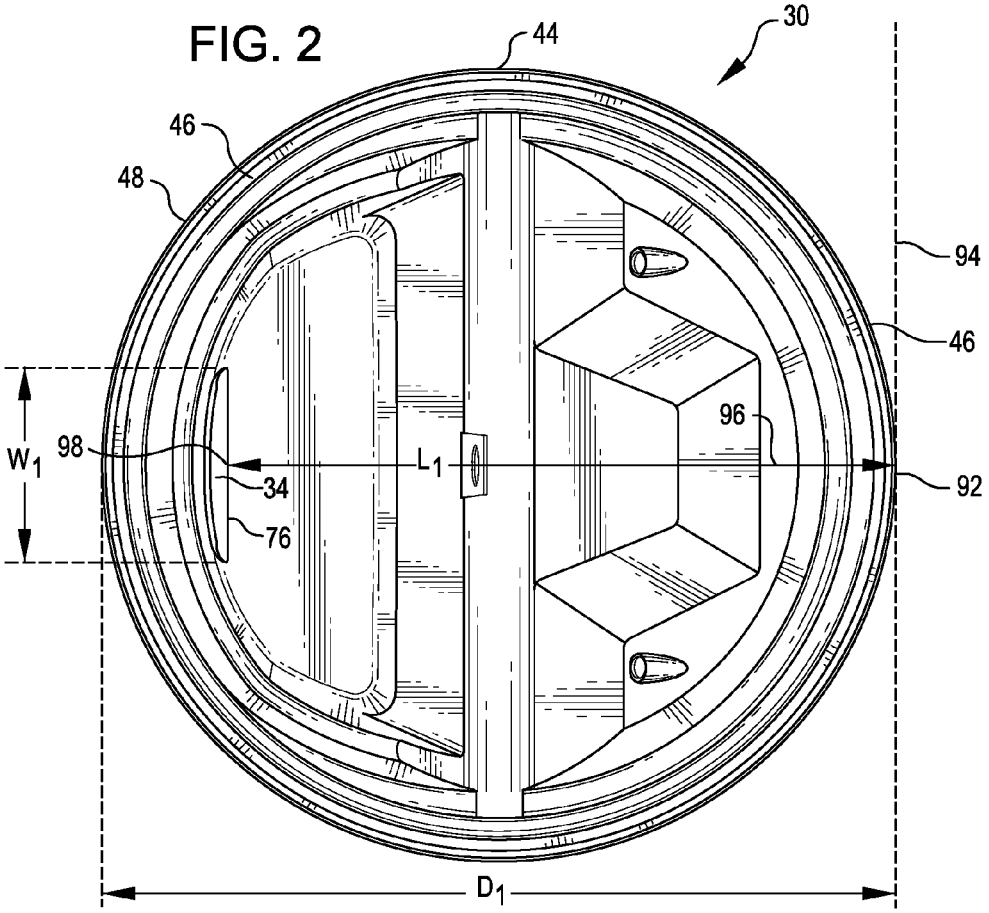
FIG. 2 is a reverse side—that is the underside—of a lid for a cup, revealing an embodiment of the lid having a drink outlet that has a lower side defined by an edgewall along a line a distance $L_1$ from a line tangent to an outer edge of the lid, wherein the line tangent to an outer edge of the lid is orthogonal to a line having an opposing end centered at the drink opening; in other words, the line tangent to the outer edge of the lid and to the edgewall that defines the lower side of the drink opening, are parallel, and may define a base for a at least one surface, which in an embodiment may be a planer surface, along which the drink opening is oriented.
Figure 3:
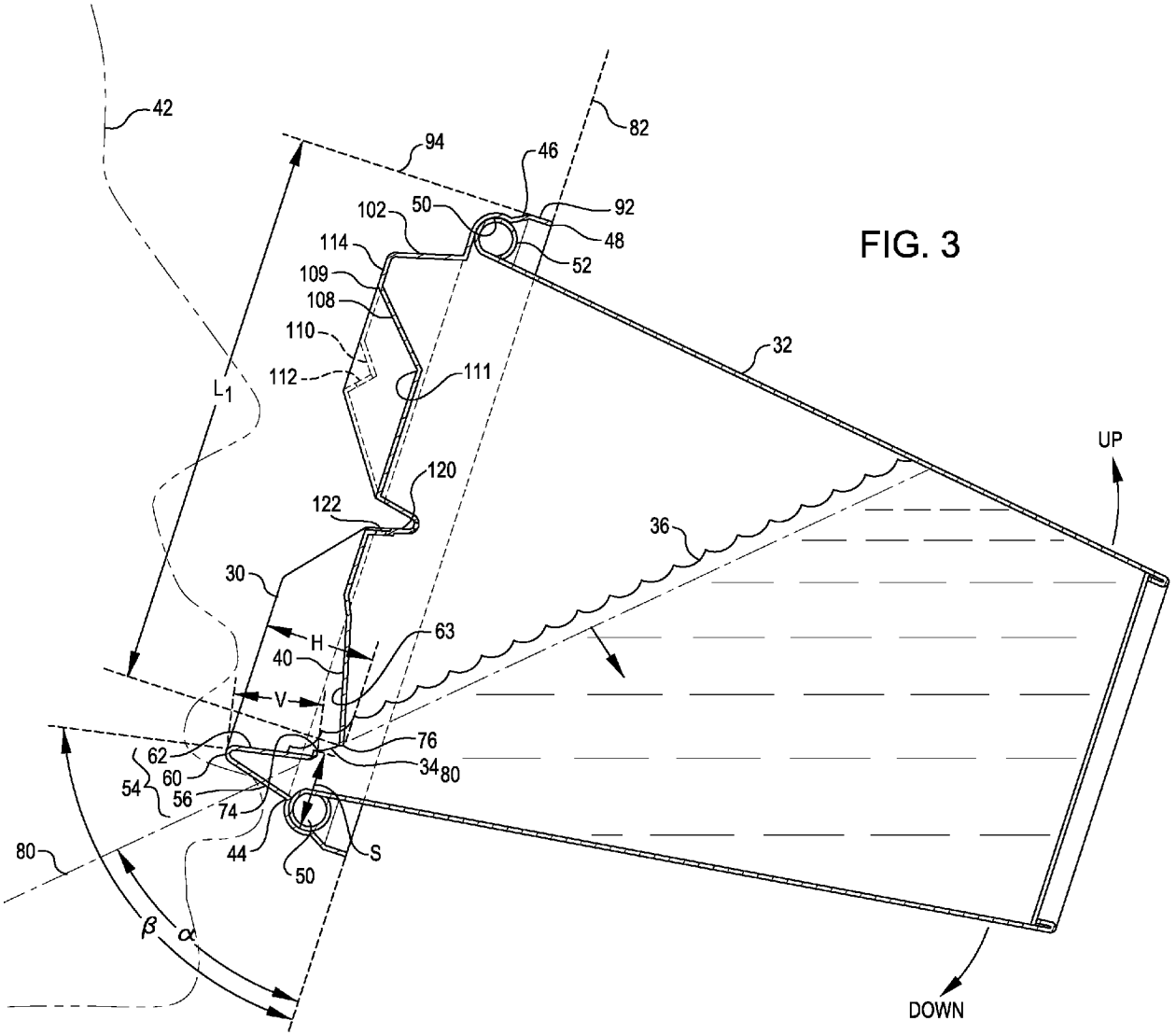
FIG. 3 reveals an embodiment for the novel lid just described in FIGS. 1 and 2, as used to provide a natural drinking experience for a beverage consumer, illustrating a first drink function of the lid described herein, showing how orienting a drink opening as just described in reference to FIG. 2 allows a liquid in a cup to reach the lower portions of the drink opening rapidly, thus minimizing or avoiding increasing or decreasing flow that might otherwise occur in various prior art designs.
Figure 4:
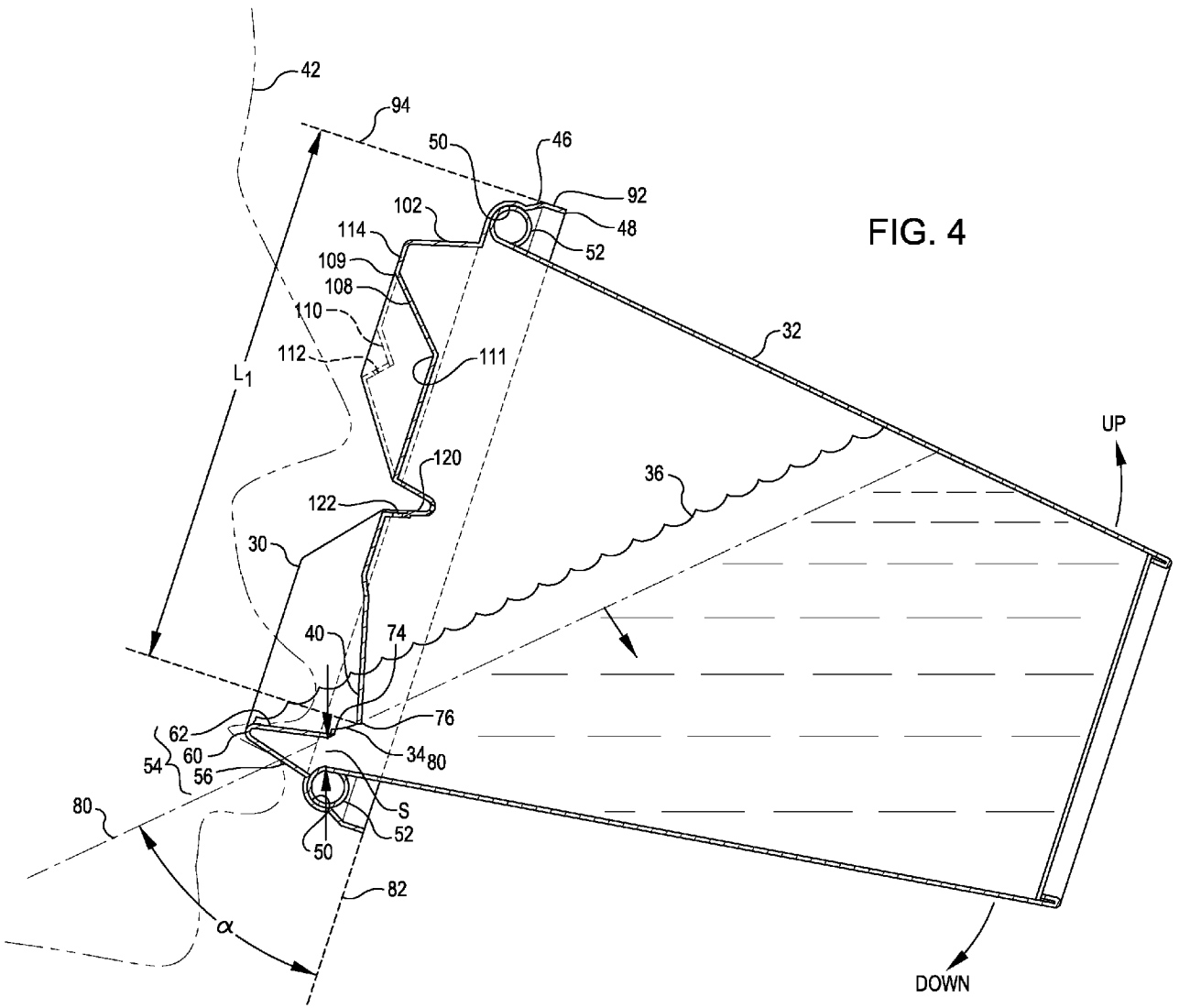
FIG. 4 is similar to FIG. 3, illustrating the novel lid just described in FIGS. 1, 2, and 3, as used to provide a natural drinking experience for a beverage consumer, illustrating a second drink function of the lid described herein, showing how a beverage consumer sips the liquid with their lips, since the liquid is contained in a drink well base behind a hollow raised lip portion above the drink well base, and is not consumed by taking liquid directly from a raised opening, as done on prior art cups having a small opening on a raised rim.
Figure 5:
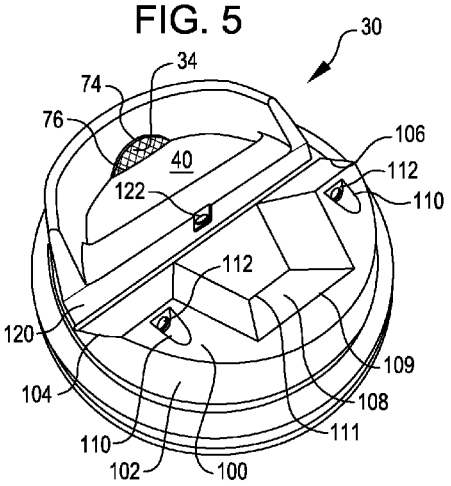
FIG. 5 is a perspective view of a novel lid as described herein, showing how a hollow raised lip portion is provided above a drink well base, and further illustrating in cross-hatching a first surface, which may be a planer surface, along which a drink opening is oriented, defined by a first edgewall cut upward into a hollow raised lip portion, as well as a lower, elongated second edgewall cut into a drink well base.
Figure 6:
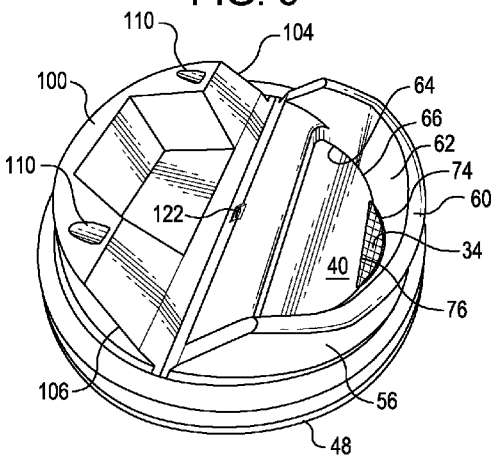
FIG. 6 is a perspective view of a novel lid as described herein, similar to FIG. 5, now seen from the opposite side, and showing how a hollow raised lip portion is provided above a drink well base, and further illustrating in cross-hatching a first surface, which may be a planer surface, along which a drink opening is oriented, defined by a first edgewall cut upward into a raised lip portion, as well as a lower, elongated second edgewall cut into a drink well base.

Attention is directed to FIGS. 1, 2, and 3, where a drink-through lid 30 for a beverage container 32 (see FIG. 3) is provided. The lid 30 provides at least one drink opening, designated as at least one drink outlet 34, that allows liquid 36 to fill a drink well base 40, from which a user or consumer 42 may sip a beverage in a manner similar to when using a cup or mug. The lid 30 has a base 44 with rim 46 having a bottom edge 48, and an interior bead sealing portion 50. In an embodiment, rim 46 may be annular in shape. The base 44 is sized and shaped to sealingly engage an open end of beverage container 32 (open end not shown but often circular), which may be defined by a bead 52 of a beverage container 32. A hollow raised lip portion 54 is provided, and it has an exterior portion 56 extending upwardly from the drink well base 40, a outer lip portion 60, and an interior portion 62 sloping downwardly and inwardly from the outer lip portion 60 to lower end portions 66. A drink well base 40 for containing liquid 36 (see FIG. 3) is provided. The drink well base 40 has a floor 63 extending from a peripheral side 64 along at least some of the lower end portions 66. In an embodiment, the floor 63 may extend upwardly and inwardly from the peripheral side 64. In an embodiment, the drink well base 40 may be located above the bottom edge 48 of the annular flanged rim 46 and substantially below the outer lip portion 60. At least one drink outlet 34 is provided. The at least one drink outlet 34 may be defined by a first edgewall 74 extending upward into the interior portion 62 of the hollow raised lip portion 54 and by an elongated second edgewall 76 extending along an outlet portion 78 of the drink well base 40 in proximity to the peripheral side 64. In an embodiment, the first edgewall 74 may be arcuate in shape. The least one drink outlet 34 is oriented along a surface 80, which in an embodiment may be a planar surface, (see FIG. 3) extending from the elongated second edgewall 76 at an angle alpha ($\alpha$) in the range of from about forty degrees (40°) to about ninety degrees (90°), compared to a plane 82 defined by the bottom edge 48 of the annular flanged rim 46, or in a any case compared to a plane defined by the centerline 82' of the interior bead sealing portion 50 (see, e.g., FIGS. 18 through 21). In various embodiment, the angle alpha ($\alpha$) may be in the range of from about fifty degrees (50°) to about seventy degrees (70°). In yet further embodiments, the angle alpha ($\alpha$) may be at about sixty degrees (60°).

As shown in FIG. 3, in an embodiment it may be desirable to provide a design where the interior portion 62 of the hollow raised lip portion 54 slopes downwardly, and in some embodiments inwardly, at an angle beta ($\beta$) in the range of from about seventy degrees (70°) to almost about ninety degrees (90°), provided that the angle selected allows removal from a mold in a manufacturing process. In various embodiments, an angle beta ($\beta$) in the range of from about seventy degrees (70°) to about eighty five degrees (85°) is provided.

Turning now to FIG. 2, it can be seen that the annular flanged rim 46 has an outer edge 92. In an embodiment, the elongated second edgewall 76 of the drink outlet 34 is defined along a line a distance $L_1$ from a line 94 tangent to the outer edge 92 of the annular flanged rim 46. The line 94 tangent to an outer edge 92 of the annular flanged rim 46 is orthogonal to a line 96 having an opposing end 98 which may be centered with respect to the elongated second edgewall 76 of drink outlet 34.

As also seen in FIG. 2, the elongated second edgewall 76 of the drink outlet 34 has an opening width $W_1$. In the embodiment shown in FIG. 2, the elongated second edgewall 76 is parallel to the line 94 tangent to an outer edge 92 of the annular flanged rim 46. In various embodiments, the width $W_1$ may be provided in a length less than or equal to about two (2) inches (5.08 cm). In various embodiments, the $W_1$ may be provided in an overall length of about one (1) inch (2.54 cm), plus or minus about fifty percent (50%). In various embodiments, the $W_1$ may be provided in an overall length of about one (1) inch (2.54 cm), plus or minus about twenty five percent (25%).

Figure 2A:
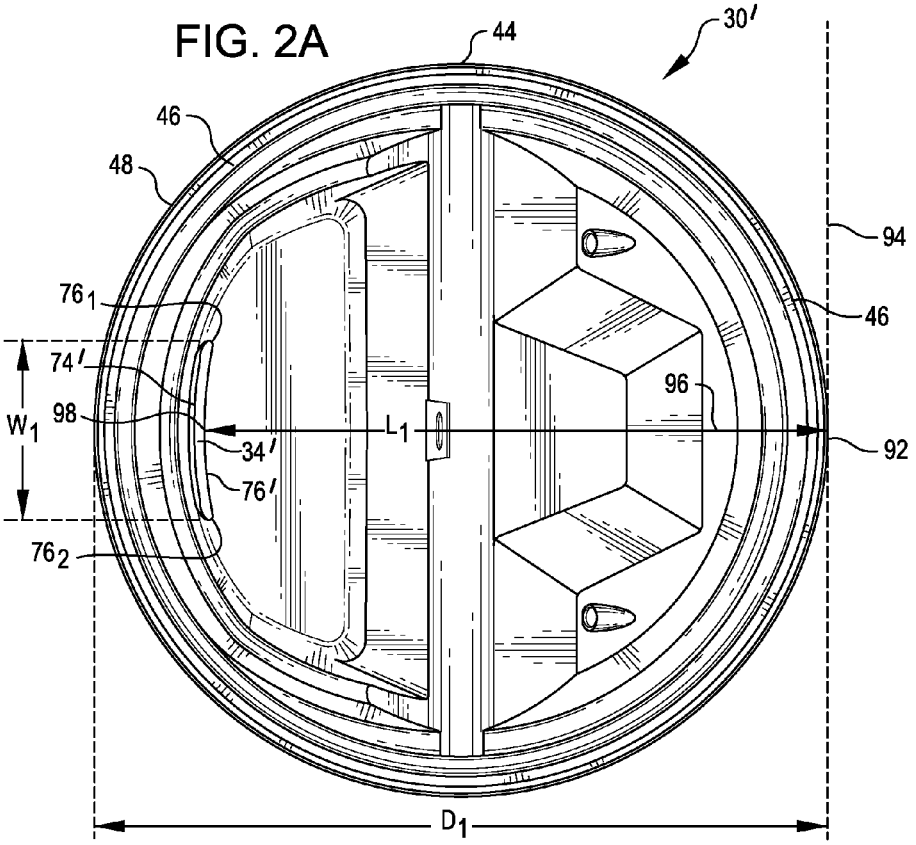
FIG. 2A is a reverse side—that is the underside—of a lid for a cup, revealing an embodiment similar to that shown in FIG. 2, but now providing a drink outlet that has a lower sidewall defined by a bow shaped edgewall, so that the outer edge of the drink is also bow shaped, and in the embodiment shown, in a complementary shape and contiguous configuration.

A similar embodiment is shown in FIG. 2A, where in a reverse side—that is the underside—of a lid 30' is provided, revealing an embodiment similar to that shown in FIG. 2, but now providing a drink outlet 34' that is formed between first sidewall 74' and an elongated second edgewall 76' that is in an outwardly bowed shape. Thus, elongated second edgewall 76' is curved between a first end $\mathbf{76}_1$ and a second end $\mathbf{76}_2$.

As seen in FIG. 3, the drink outlet 34, as defined by the portion 3480 of surface 80 that matches the drink outlet 34, is spaced apart from, but adjacent to, the interior bead sealing portion 50 of drink-through lid 30, so that the drink outlet 34 fills with liquid 36 above drink well base 40, along floor 63, promptly when a beverage container 32 utilizing the drink-through lid 30 is turned from a vertical position. As further illustrated in FIG. 21 with respect to lid 130, in an embodiment, the radially outermost point $R_O$ of first edgewall 74 of drink outlet 34 may be spaced a distance S of about zero point three (0.3) inches (0.762 cm), or less, from a reference plane $P_R$ located at the interior bead sealing portion 50 of lid 30. 22. As also may be appreciated with reference to FIG. 21, in an embodiment, a drink-through lid may be provided wherein a total open passageway area of the one or more drink outlets 34 amounting to at least zero point zero six (0.06) square inches (0.3871 square centimeters) is provided at a location within zero point five (0.5) inches (1.27 cm) radially inward from of a reference line $P_R$ located at the interior bead sealing portion. In some embodiments, it may be appropriate to provide all of the total of open passageway area of the one or more drink outlets 34 within a location between a reference plane $P_R$ located at said interior bead sealing portion and a location not more than zero point five (0.5) inches (1.27 cm) radially inward therefrom. In various embodiments, a drink-through lid may be provided wherein at least some open area of the one or more drink outlets is located between a reference plane $P_R$ located at the interior bead sealing portion and a location not more than zero point four (0.4) inches (1.016 cm) radially inward therefrom. In various embodiments, the floor 63 of the drink well base 40 may include low point in the floor 63 that provides a liquid drain, which may be located at elongated second edgewall 76. In an embodiment, a liquid drain may be located at the radially inward point $R_I$ of the liquid outlet 34, and co-terminus therewith. In various embodiments, the floor 63 may slope, at least in part, in an outward direction toward interior portion 62 of the hollow raised lip portion 54.

Figure 21:
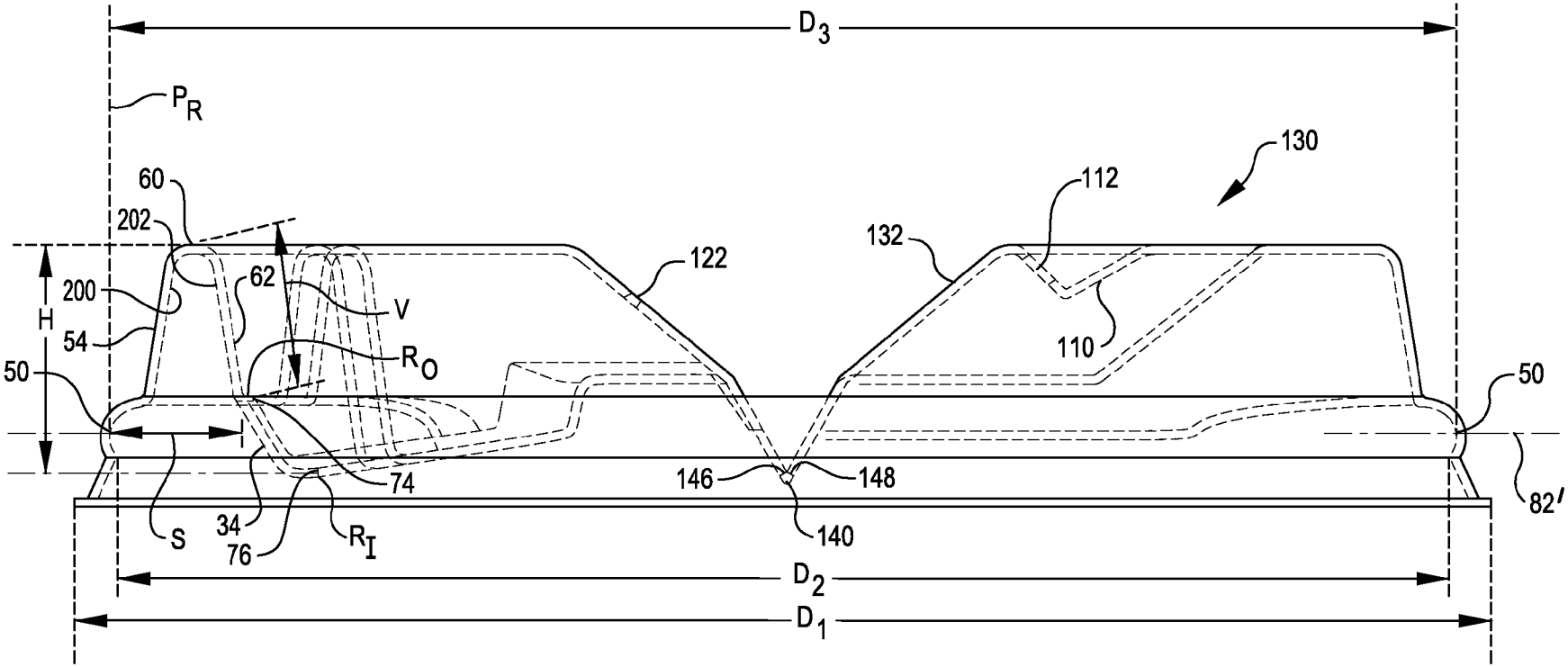
FIG. 21 is a cross-sectional view of a design for a disposable lid, showing an embodiment wherein the drink outlet's radially innermost and radially outermost ends are located distances $R_I$ and $R_O$, respectfully, from the innerwall of the interior bead sealing portion of the lid, as well as indicating an interference fit minimum diameter $D_2$ of the lid which allows stable snap fit of the disposable lid to the open end of a complementary sized beverage container within the interior bead sealing portion of diameter $D_3$ portion of the lid.

As shown in FIG. 3, and in FIG. 21, the outer lip portion 60 of the hollow raised lip portion 54 may have a height H in the range of from about four-tenths of an inch (0.4 inches) (1.016 cm) to about nine-tenths of an inch (0.9 inches) (2.286 cm) above the elongated second edgewall 76 of the drink outlet 34, which in an embodiment may be at the radially innermost edge $R_I$ of the drink outlet 34. Also, a vertical surface distance V may be set for the interior portion 62 of the hollow raised lip portion 54, in the range of from about zero point two four (0.24) inches (0.6096 cm) to about zero point six nine (0.69) inches (1.7526 cm). See vertical surface distance V and related structures as shown in FIG. 21 below, with respect to like features of lid 130. In an embodiment, one or more drink outlets 34 may be provided. In an embodiment, one or more drink outlets 34 may define a total open area in the range of from about zero point zero six (0.06) square inches (0.3871 square centimeters) to about zero point two five (0.25) square inches (1.613 square centimeters). In an embodiment, the one or more drink outlets 34 may define a total open area in the range of from about zero point zero seven five (0.075) square inches (0.4839 square centimeters) to about zero point two (0.2) square inches (1.2903 square centimeters). In an embodiment, the one or more drink outlets 34 may define a total open area in the range of from about zero point one three (0.13) square inches (0.8387 square centimeters) to about zero point two (0.2) square inches (1.2903 square centimeters). In an embodiment, the one or more drink outlets may define a total open area of about zero point two (0.2) square inches (1.2903 square centimeters), or less.

Figure 22:
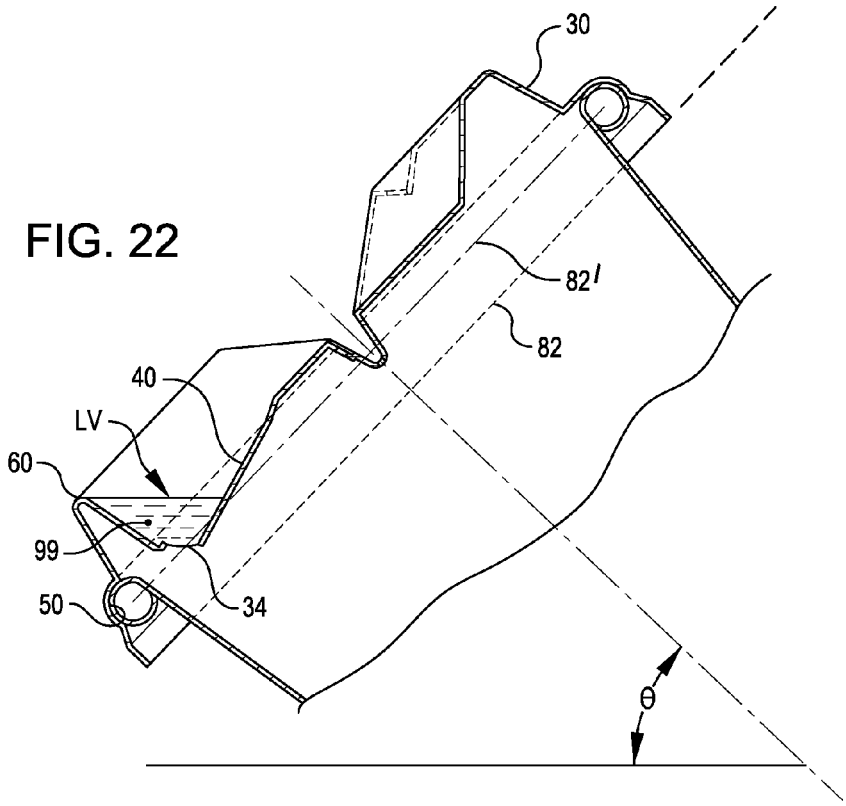
FIG. 22 is a partial cross-sectional view of a design for a disposable lid, showing a method for measurement of the drink well volume, by sealing the drink outlet and tipping the lid at a forty five degree (45°) angle.
Figure 17:
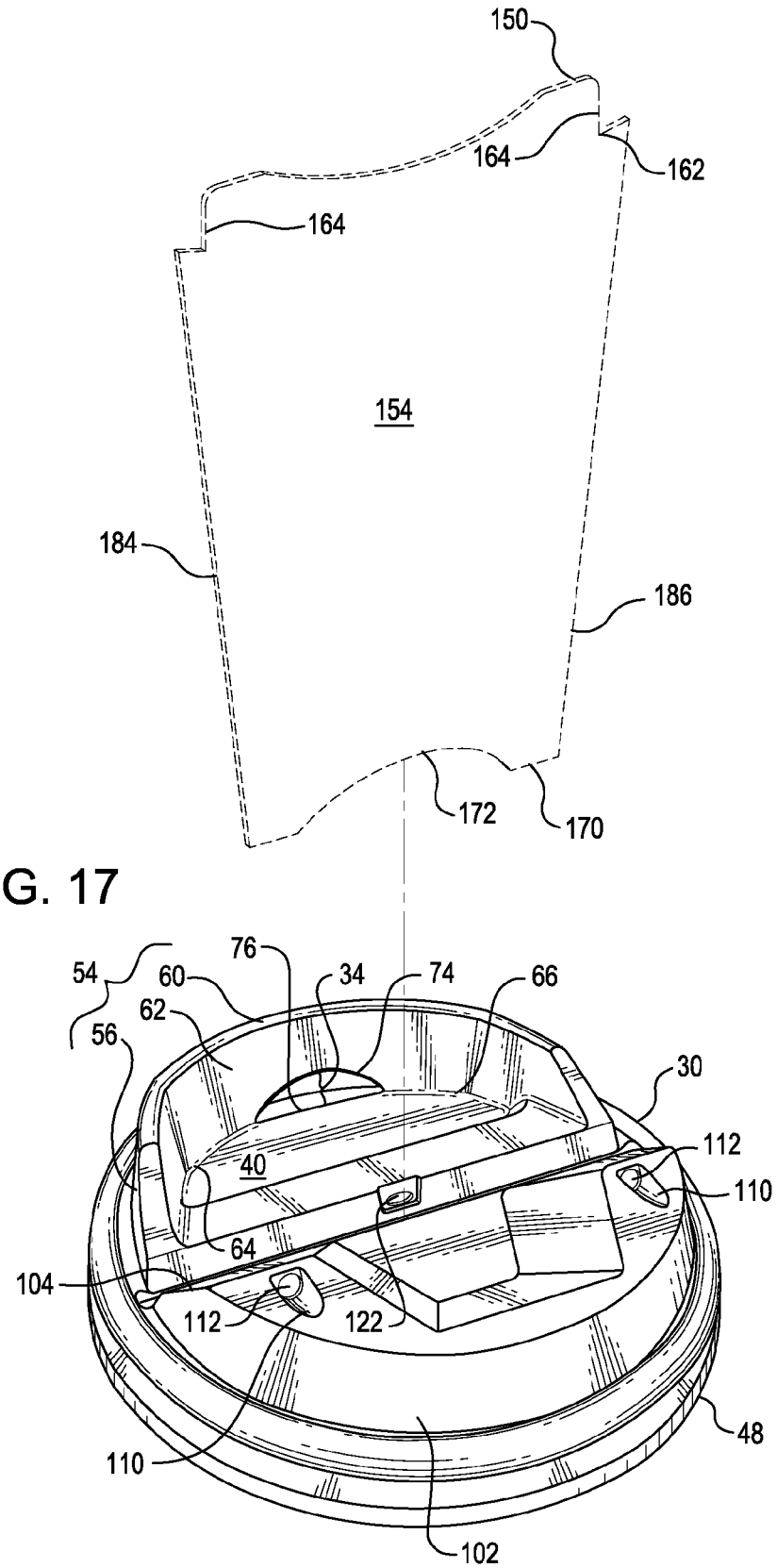
FIG. 17 is a perspective view of a design for a disposable lid for a beverage container, the lid having a slot therein for accommodating a baffle for enhancement of a beverage drinking experience by using fluid flow dynamics, in this embodiment with respect to flow of both vapor and liquid, to direct aroma toward the nose of a user.

As illustrated in FIG. 22, the drink-through lid 30 may have a drink well base 40 that is sized and shaped to contain a selected liquid volume LV of liquid 99. In an embodiment, the drink well base 40 may be sized to contain a liquid volume LV of about zero point one six (0.16) fluid ounces (4.73 milliliters), or more, when measured with the lid 30 tipped at a forty five degree (45°) angle theta ($\theta$), and the liquid outlet 34 being sealed closed, and the lid 30 being filled with liquid 99 to the limits of the outer lip portion 60.

In an embodiment, a drink-through lid 30 may further include a vapor dome 100. The vapor dome 100 may include a raised sidewall 102 extending upwardly from the base 44. In an embodiment, the vapor dome may be at least partially arcuately shaped between first 104 and second 106 sidewall ends. An interior vapor dome wall 108 having an upper end 109 and a lower end 111 may be provided, and extending across the lid from first 104 to second 106 sidewall ends, and a vapor dome face 114 extending between the raised sidewall 102 and the upper end 109.

In an embodiment, a drink-through lid 30 having a vapor dome 100 further includes at least one vapor vent well 110. Each vapor vent well 110 may include at least one vapor-directing passageway 112 therein. In an embodiment, a drink-through lid 30 may include two or more vapor vent wells 110. In various embodiments, the lid 30 may include a downwardly extending, generally trough shaped walls 120 provided in a v-shaped configuration, and extending transversely across the drink-through lid 30. In an embodiment, a v-shaped wall 120 may be provided oriented parallel to the elongated second edgewall 76 of the drink outlet 34. In an embodiment, one or more vapor passageways 122 may be provided through downwardly extending v-shaped wall 120. In an embodiment, at least one of the one or more vapor passageways 122 may be oriented to project vapors away from the drink outlet 34.

Figure 7:
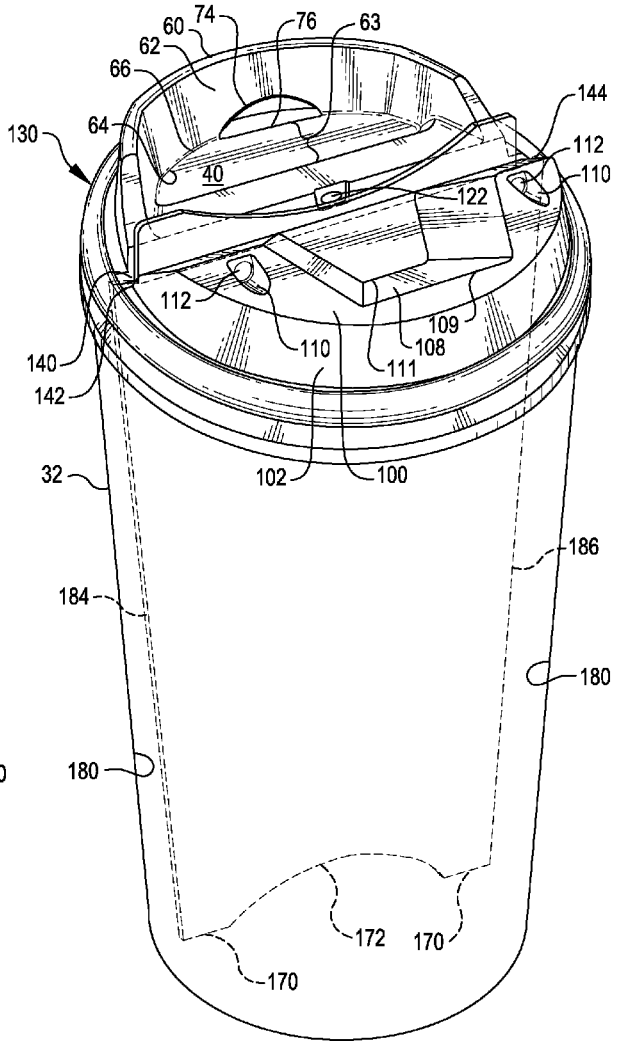
FIG. 7 is a perspective view of another embodiment for a novel lid, similar to the lid described above in connection with FIGS. 1-6, but now additionally providing a centrally oriented slit along a line across the top of the lid sufficiently wide to allow use of a downwardly extending baffle, here shown in broken lines, to extend downward within the drinking cup and extending laterally to engage with the upwardly and outwardly sloping sidewalls of a drinking cup.
Figure 8:
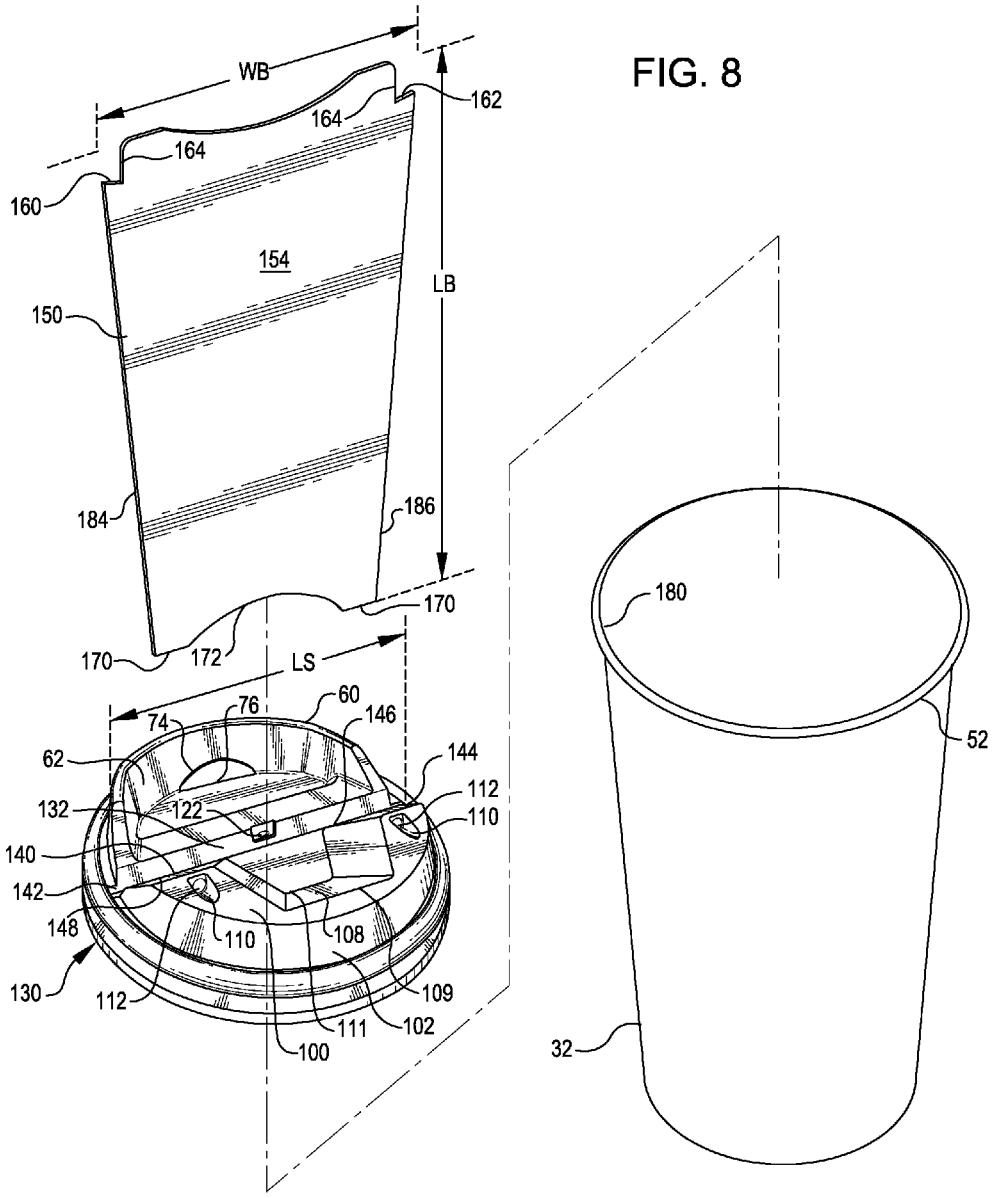
FIG. 8 is an exploded perspective view of an embodiment for a lid as just illustrated in FIG. 7, now additionally showing the assembly of a baffle, lid, and cup into a working combination, and also revealing details of an embodiment for a downwardly extending baffle, including opposing locking notches that secure a baffle to a lid.
Figure 9:
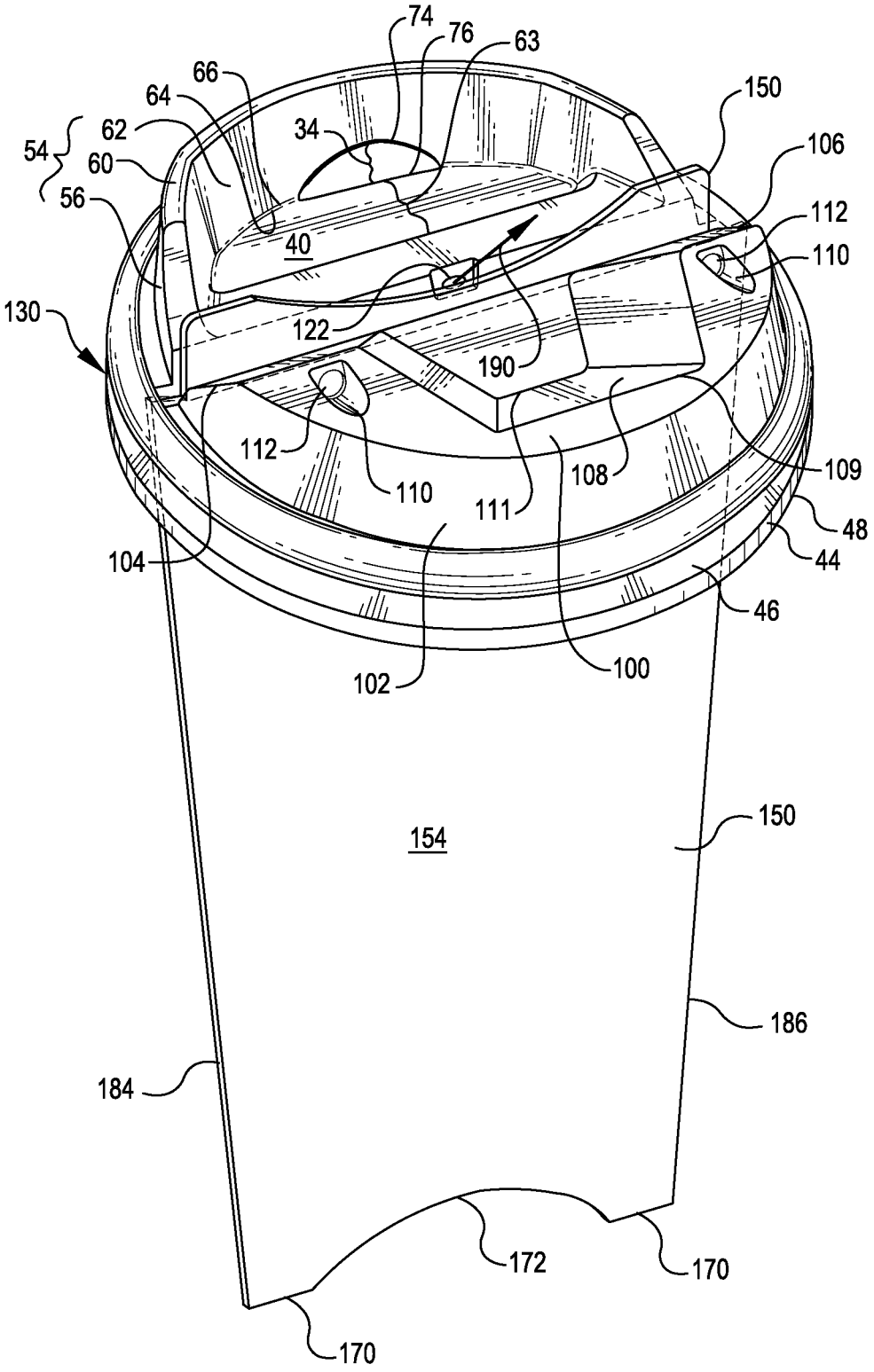
FIG. 9 is a perspective view of an embodiment for a lid as shown in FIGS. 7 and 8, now additionally showing some details of a downwardly extending baffle when locked into place for insertion into a cup.

Turning now to FIGS. 7, 8, 9, 13 and 21, yet another embodiment for a drink-through lid 130 is provided. The drink-through lid 130 includes a downwardly extending wall 132 that extends transversely across the drink-through lid 130. In an embodiment, a trough shaped wall 132 may be provided, such as in a V-shape or U-shape, oriented parallel to an elongated second edgewall 76 of a drink outlet 34. A slit 140 of length LS is formed along a line, which in an embodiment may be a partial chord line (extending in a chord like direction but not extending all the way to the edges of the base) with respect to a circular shaped base, as indicated in FIG. 8. The slit 140 is provided between first end 142 and second end 144, and along a first edge 146 and a second edge 148 formed by wall 132.

As seen in FIG. 8, a baffle 150 may be provided. The baffle 150 may be provided in a generally trapezoidal shaped configuration having an overall width WB complementary to length LS for insertion downward through said slit 140. In one configuration, before the baffle 150 is inserted in lid 130, as illustrated in FIGS. 8 and 21, the slit 140 forms a first stable condition wherein the first edge 146 and second edge 148 are urged together to substantially prevent liquid leakage therethrough. In another configuration, as seen in FIGS. 9, 10, 11, and 12, a second stable condition may be provided wherein the first edge 146 and said second edge 148 are urged toward the respective first 152 and second 154 sides of baffle 150, to substantially prevent liquid leakage therethrough.

Figure 14:
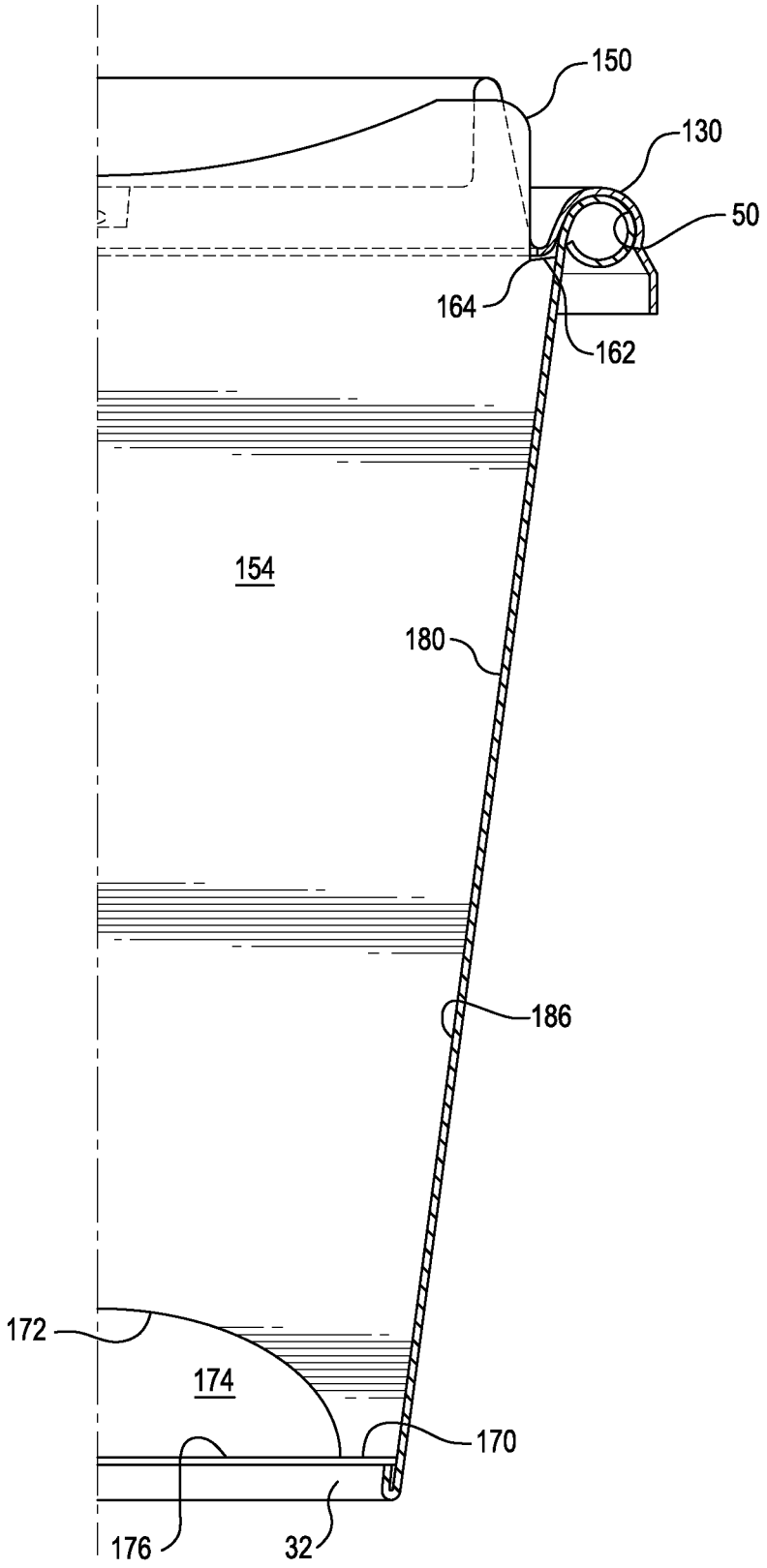
FIG. 14 provides a partial side view, taken as if through a portion of line 14-14 of FIG. 13, to show a baffle locked into place in a lid, and placed into a cup.
Figure 15:
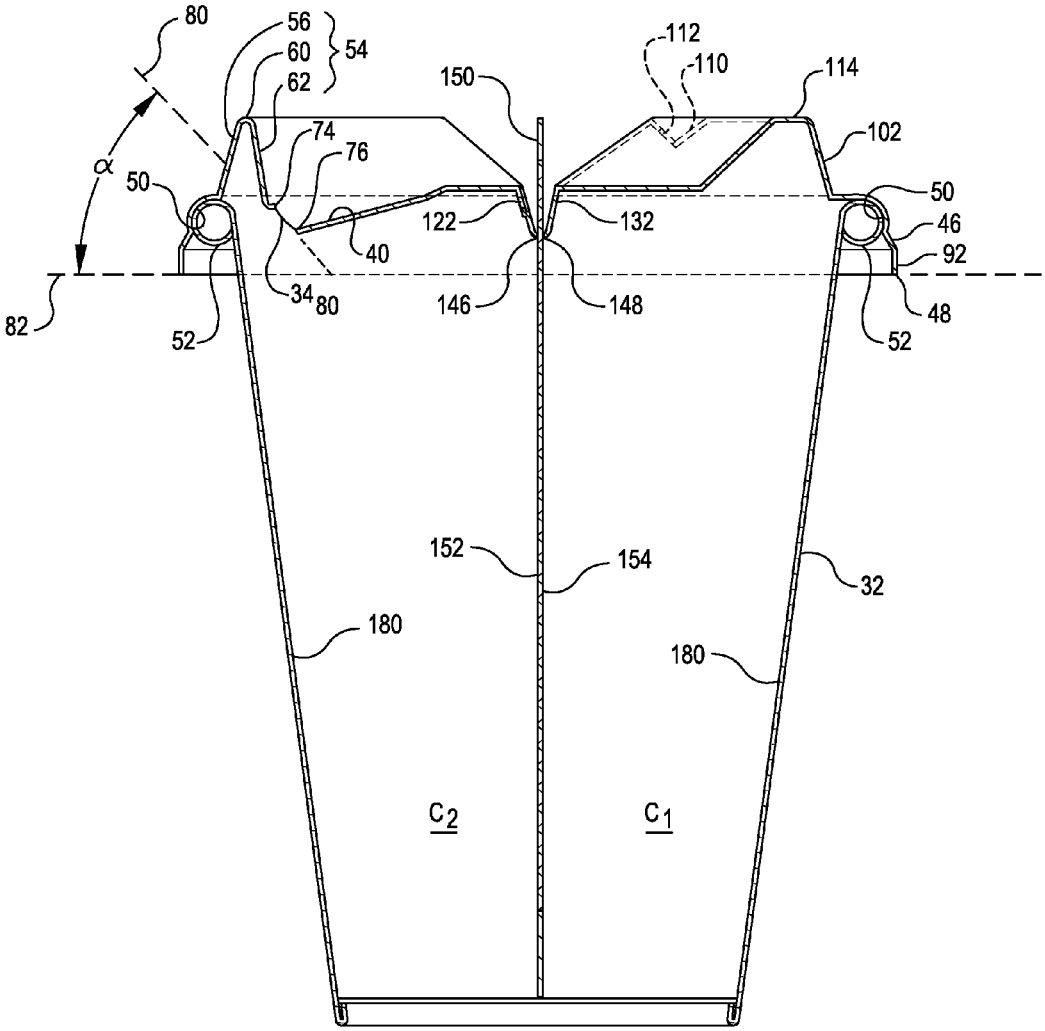
FIG. 15 provides a vertical cross-sectional view, taken through line 15-15 of FIG. 13, now showing inwardly and downwardly sloping shaped center sidewalls and a baffle accommodating slit in a lid, and a baffle in working position, and also the vapor-directing passageways in a lid.
Figure 16:
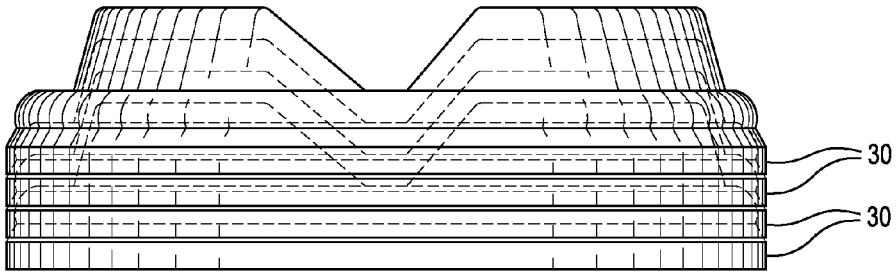
FIG. 16 provides a side view of an embodiment of the lids described herein, showing how the lids may be stacked for compact storage.

In an embodiment, as seen in FIG. 14, the baffle 150 may further include edge locks 160 and 162. The edge locks 160 and 162 are sized and shaped for locking engagement with first 142 and second 144 ends of the slit 140. In an embodiment, as seen in FIG. 8, the edge locks 160 and 162 may include notches 164 in the baffle 150.

Figure 12:
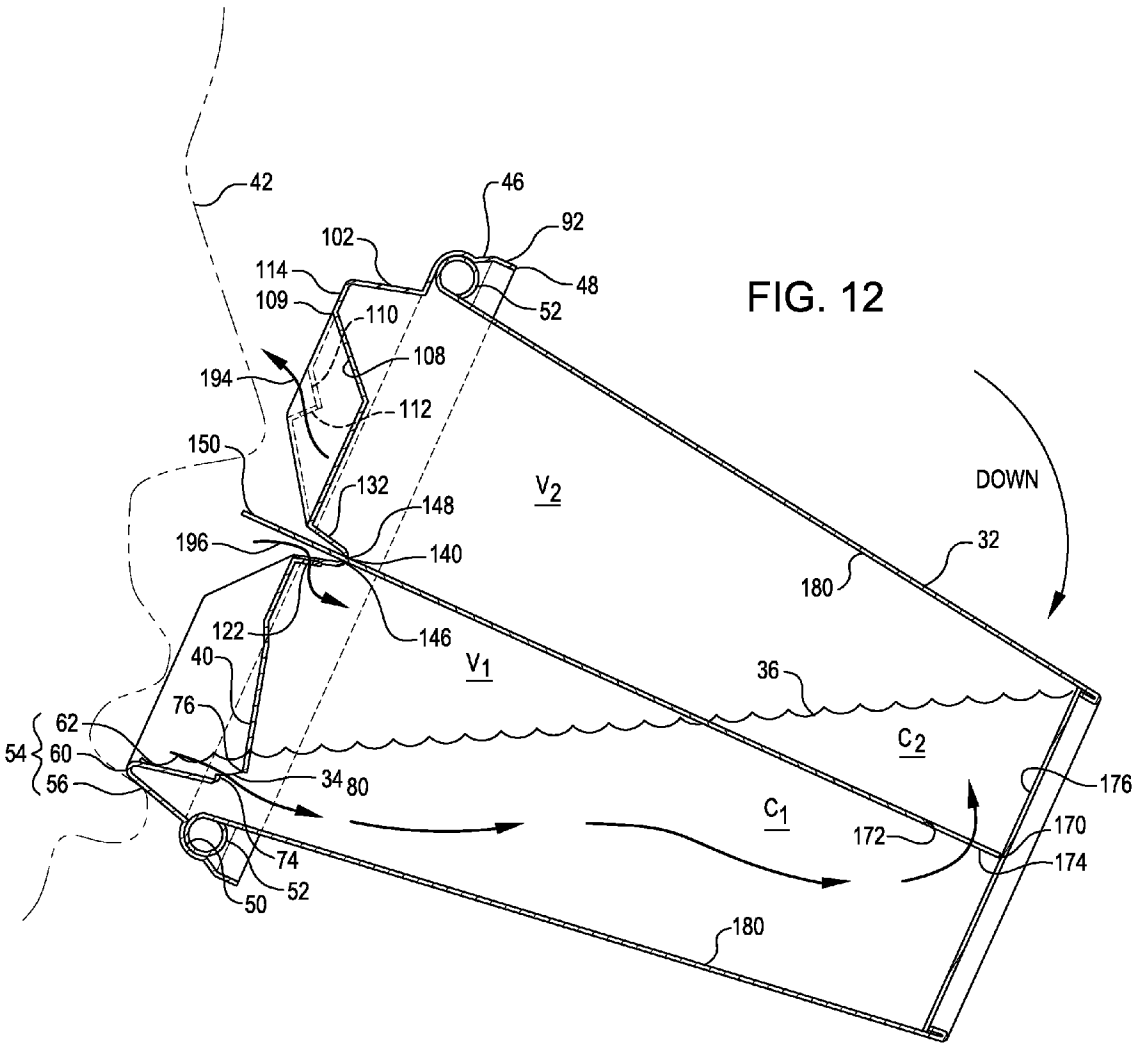
FIG. 12 provides a functional illustration of the novel lid and baffle combination described herein, here showing in a third baffle functional illustration how the liquid holding area external to the drink outlet drains when the cup is returned to an upright position.
Figure 13:
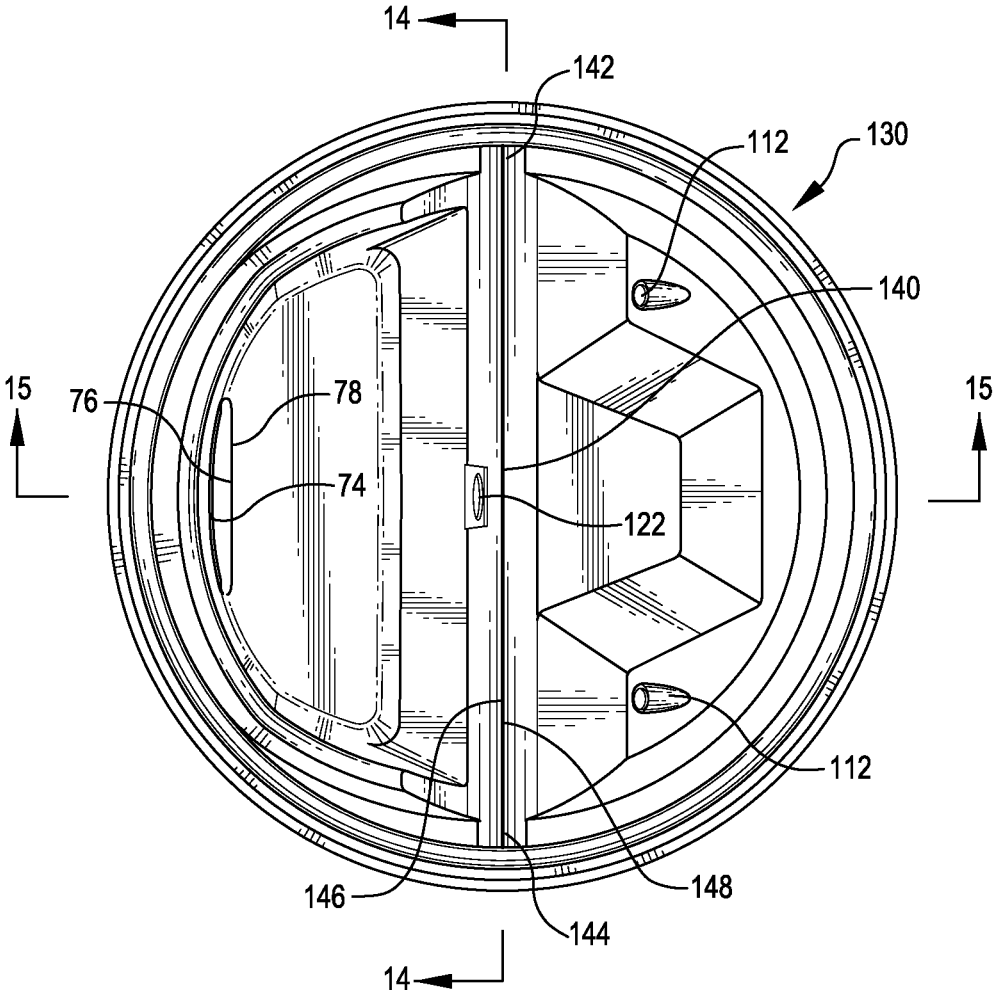
FIG. 13 is similar to FIG. 2 above, however provides a bottom view of an embodiment for lid further including a slit therein, and thus adapted for receiving a baffle therethrough, and also showing a centrally located vapor passageway, and other vapor passageways, and showing a functional illustration of the novel lid suitable for use with the baffle combination described herein, and also shows a lower side of a drink opening as defined by an elongated second edgewall along an outlet portion of the drink well base.

In an embodiment, as also seen in FIG. 14, the baffle 150 may include a lower end 170. The lower end may include an upwardly extending lower baffle wall 172. The lower baffle wall 172 may define, in combination with beverage container 32, a liquid passageway 174 above bottom 176 of beverage container 32, as seen in FIGS. 10, 12, and 14.

As seen in FIGS. 7 and 14, the beverage container 32 may include an inner sidewalls 180 that are generally frusto-conical in shape, and in such an embodiment, the baffle may include a first side 184 and a second side 186 that are complementary in shape with the beverage container inner sidewalls 180. In an embodiment, first side 184 and second side 186 of baffle 150 are shaped and sized for sealing engagement with the beverage container inner sidewalls 180.

Figure 10:
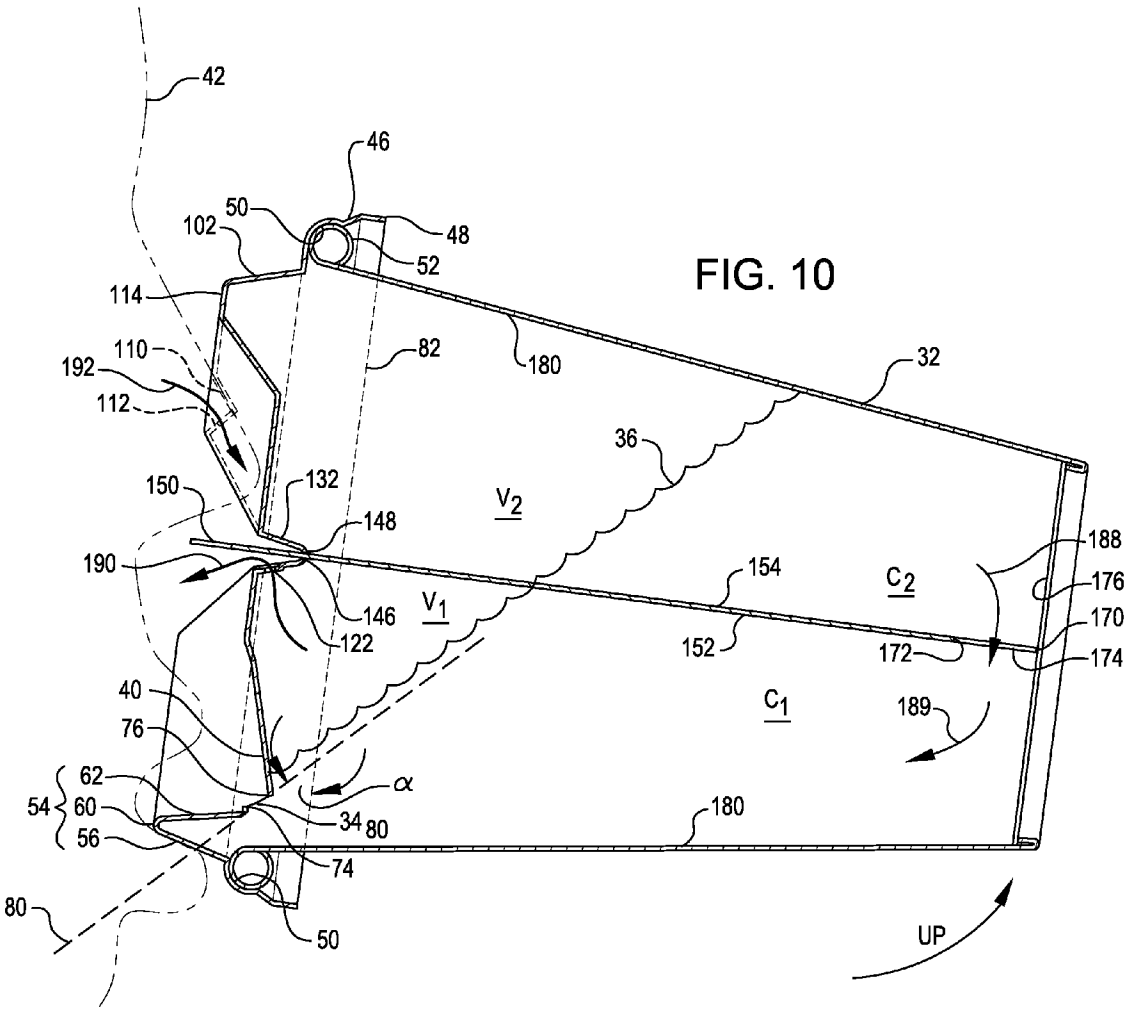
FIG. 10 provides a functional illustration of the novel lid and baffle combination described herein, showing in a first baffle functional illustration how aroma containing vapors from a beverage are directed toward a user's nose from a central vapor passageway, and how vapors from a beverage are directed past a user's lips toward his or her nose, from the surface of a liquid as such liquid surface approaches, and reaches a drinking opening. Passage of outside air through one or more vapor-directing passageways, for pressure relief to allow better pressure equalization and allowance of liquid flow, is also shown.
Figure 11:
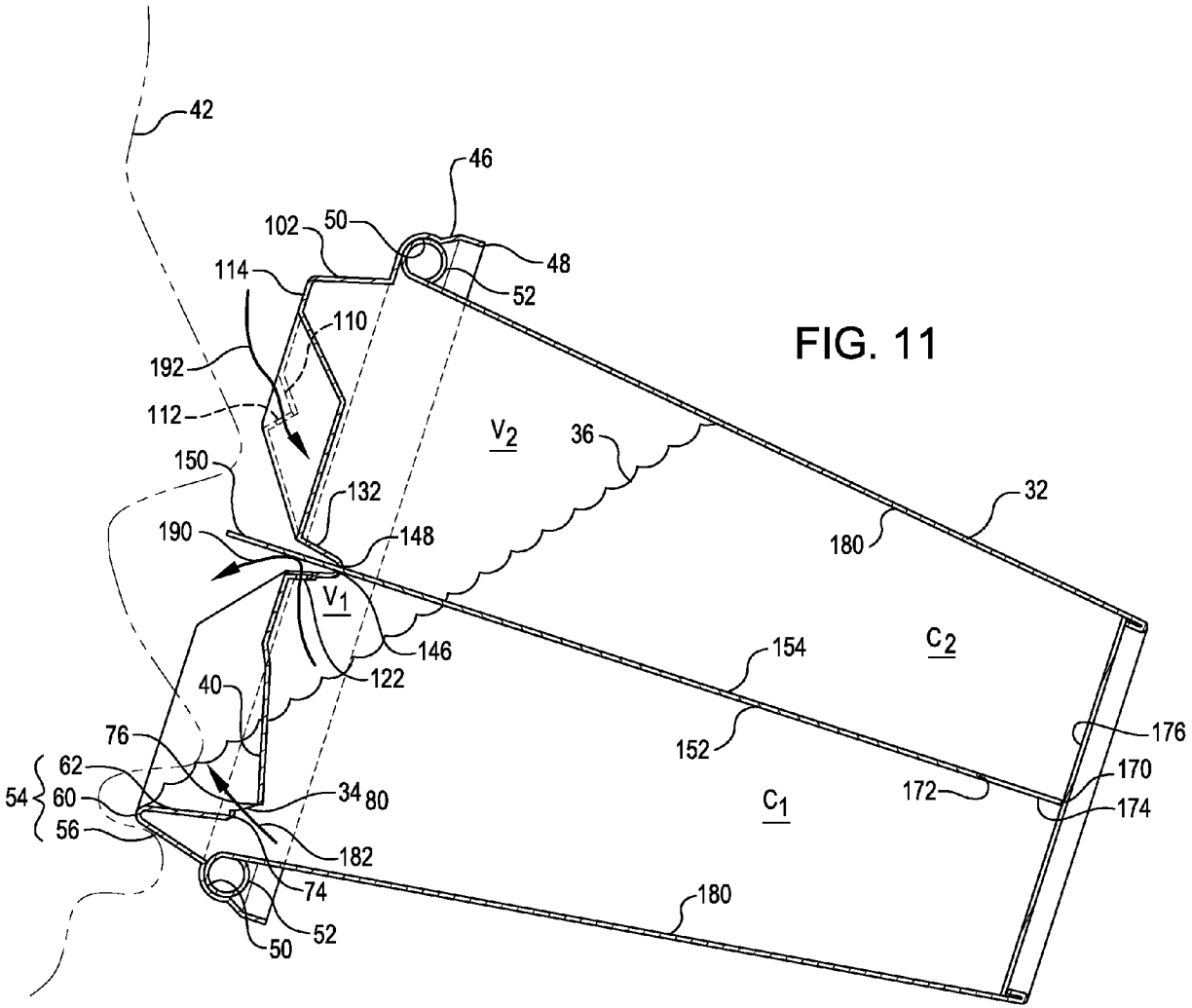
FIG. 11 provides a functional illustration of the novel lid and baffle combination described herein, here showing in a second baffle functional illustration how aroma containing vapors from a beverage are directed toward a user's nose when the drink well base, that is, the liquid holding area external to the drink outlet, fills with liquid and allows such aroma containing vapors to be swept upward, such as by inhaling of such vapors on the part of the user. Also, illustrated is how at this point when a cup using the lid and baffle direct vapors toward a user's nose from a centrally located vapor passageway.

The baffle 150 divides the beverage container 32 into at least a first chamber $C_1$ and a second chamber $C_2$, and in such a configuration, the baffle 150 is shaped and positioned to allow liquid 36 in the beverage container to flow freely between each of the chambers $C_1$ and $C_2$, using liquid passageway 174, as seen in FIG. 10 at reference arrows 188 and 189. The baffle is effectively sealed with the drink-through lid at said slit 140, and positioned to prevent vapor $V_1$ within the first chamber $C_1$ that is between the drink-through lid 130 and liquid 36 in the beverage container 32 from flowing to the second chamber $C_2$. In this manner, associated with each of the chambers $C_1$ and $C_2$, is at least one vapor-directing passageway(s) 112 and/or at least one vapor passageway(s) 122. Further, vapor-directing passageways 112 and/or vapor passageways 122 are disposed in the lid 30 on either side of the baffle 150. Thus, when the beverage container 32 contains liquid 36 and is tipped (see FIG. 11) to allow liquid to flow out of the drink outlet 34, as indicated by reference arrow 182, vapor $V_1$ within the first chamber $C_1$ is forced out of one or more of the at least one vapor passageways 122 as indicated by reference arrow 190, while air outside of the beverage container is simultaneously drawn into the second chamber $C_2$ through one or more of the at least one vapor-directing passageways 112 as indicated by reference arrow 192. Likewise, when the beverage container 32 is tipped down, after drinking is completed, as shown in FIG. 12, vapor $V_2$ exits the second chamber $C_2$ through one or more of the vapor-directing passageways 112, as indicated by reference arrow 194. As liquid 36 retreats in the first chamber $C_1$, outside air passes through vapor passageway(s) 122 to replenish the vapor $V_1$ within the first chamber $C_1$, as indicated by reference arrow 196. In various embodiments, the at least one vapor passageways 122 may be oriented to project vapors initially in a direction that is predominantly horizontal in relation a plane along a centerline 82' of said interior bead sealing portion 50.

In various embodiments, either or both of the lid 30 or baffle 150 may be made from thermoplastic material. In an embodiment, such thermoplastic material may be suitable for vacuum forming of the lid 30. In an embodiment, baffle 150 may be provided in a selected composition of paper or paperboard.

In various embodiments as disclosed herein, a drink-through lid (30, or 130) design is disclosed herein that provides a drinking experience to a user much the same as if the user were drinking from an open container such as a coffee cup, rather than using various prior art disposable drink-through lids for drinking cups. Improved user interface is accomplished by selecting the size and shape of the drink outlet 34, in combination with providing a suitable size and shape of the drink well base 40 floor 63 shape, so that when a beverage cup 32 is tipped in normal drinking fashion, the liquid gently hits the user's lips, thus providing a "soft" feel to the user.

In one aspect, a design is provided that when used for drinking provides a wide, relatively slow moving liquid surface when the liquid approaches the user's lips. In an embodiment, this is accomplished by providing a liquid outlet that provides a "fountain" effect caused by the vector of the liquid emerging from the drink outlet. The "fountain" effect is powered by the head pressure created when the liquid inside the container is at a higher elevation than the drink outlet. Because the height of the liquid is determined by angle that the beverage cup 32 is tilted, the more that the beverage cup is tilted, the higher the height of the liquid as compared to the drink outlet, and thus, the more hydraulic head. Of course, the rate of change of head pressure and the duration that the head pressure is at a particular point determines how fast the drink well floor fills with liquid. The fountain effect is largely determined by the location, orientation, and sizing of the drink outlet 34, which determines the origin and direction of the fill vector in relation to the user's lip, and the time required for drink well filling. With respect the size of the drink outlet 34, in an embodiment, the origin and direction of the fill vector provides an emerging liquid fountain that is predominantly vertical when the beverage cup 32 is in a tipped, drinking orientation. Thus, the size of the drink outlet 34 determines how far the liquid fountain projects when the beverage cup 32 is tipped by a user for drinking.

With respect to proper sizing of a drink outlet 34, if the drink outlet 34 opening itself is too small, the drink well base 40 does not fill fast enough, which may result in the user overtipping the beverage cup 32. Too small of a drink outlet 34 may also result in a liquid fountain that is too high, in that such a "fountain" may shoot up and hit the user's lip in an unsatisfying way. Too large of a drink outlet 34 can sacrifice the splash and spill protection provided by the lid 30. The key is to provide a drink opening 34 which is large enough so that, given the tip rate of a beverage cup 32 by a user, (a) results in the filling of a drink well base 40 to the point that liquid reaches the user's lip fast enough so that the user does not "over tip" and create excessive head pressure, and (b) results in the filling of the drink well base 40 with a liquid having a surface that is relatively calm—flat rather than turbulent—when the liquid reaches the user's lip. Thus, when the beverage cup 32 is tipped, the vertical component of the liquid fountain provides liquid that quickly emerges, but then spreads out promptly in the drink well base 40, so that as the drink well base 40 fills, the leading edge of liquid—that is the edge closest to the user's lips, spreads out widely and slowly toward a user's lip.

Further, it has been found that selecting an optimum shape for the drink well base 40, and the interaction of the drink well base 40 with the drink outlet 34, may also provide benefits to enhance the drinking experience of a user. For purposes of example only, and not by way of limitation, in an embodiment it has been found that a suitable shape for a drink well base 40 may be provided as a generally wedge shaped volume, structured for example in much the same shape as a segment of a small orange (or similar fruit) laid out so that the center of the segment is across the lid, and one side of the segment is horizontal, and the other size extends angularly downward from the center of the segment toward the bottom of the drink outlet to provide an arcuate side shape approximating the interior portion 62 shape of a raised hollow lip portion 54 of the drink-through lid 30. Such shape can be easily envisioned in FIG. 22, where liquid 99 is shown along the interior portion 62 of the hollow raised lip portion 54. In contrast to many prior art patents which have just a lower tangent edge of a drink outlet (such as of a circle or of an ovoid shape at the lower reaches of a drink well), experimentation during development of the drink-through lid 30 or 130 as disclosed herein reveals that better drinking experience results are achieved if at least a portion of an elongated bottom, i.e. an elongated second edgewall 76, of a drink outlet 34 is provided along the lower reaches of the drink well base 40, rather than merely as a tangent portion, as provided in certain prior art patents.

Figure 18:
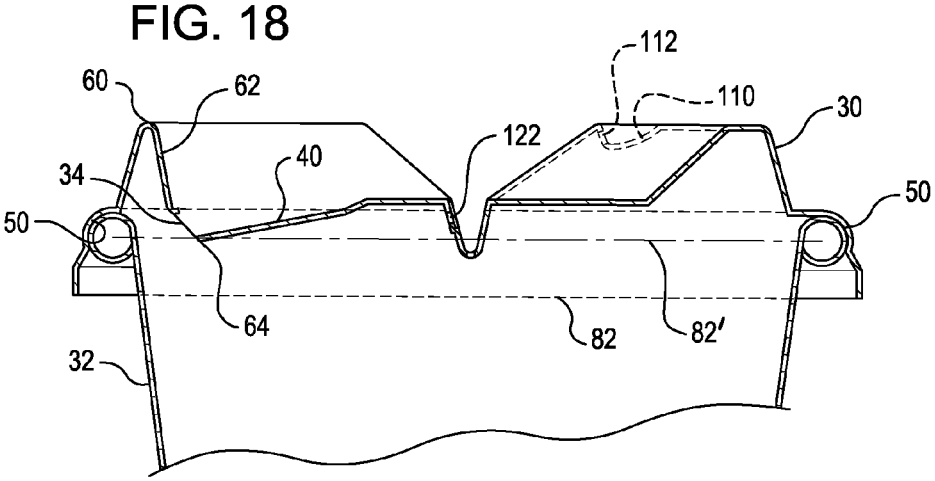
FIG. 18 is a partial cross-sectional view of a design for a disposable lid, showing an embodiment wherein the lower end of the floor of a drink well base is located at a level at or about the centerline of the interior bead sealing portion of the lid.
Figure 19:
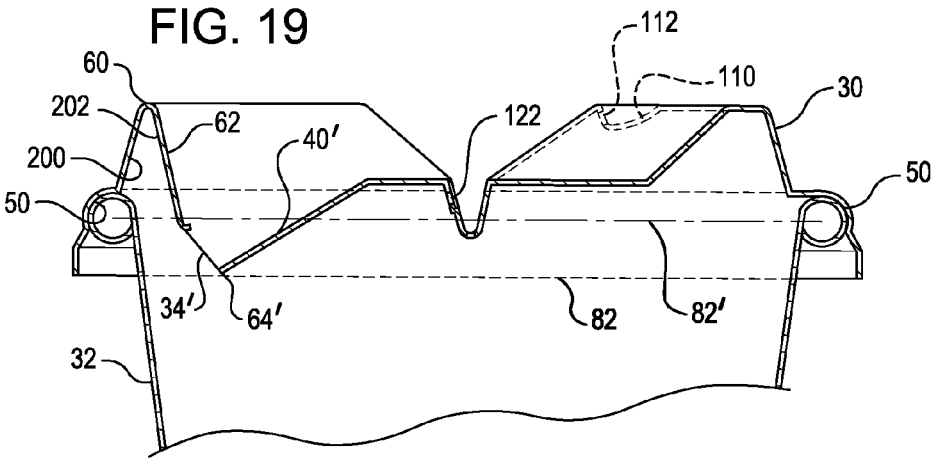
FIG. 19 is a partial cross-sectional view of a design for a disposable lid, showing an embodiment wherein the lower end of the floor of a drink well base is located at a level below the centerline of the interior bead sealing portion of the lid.
Figure 20:
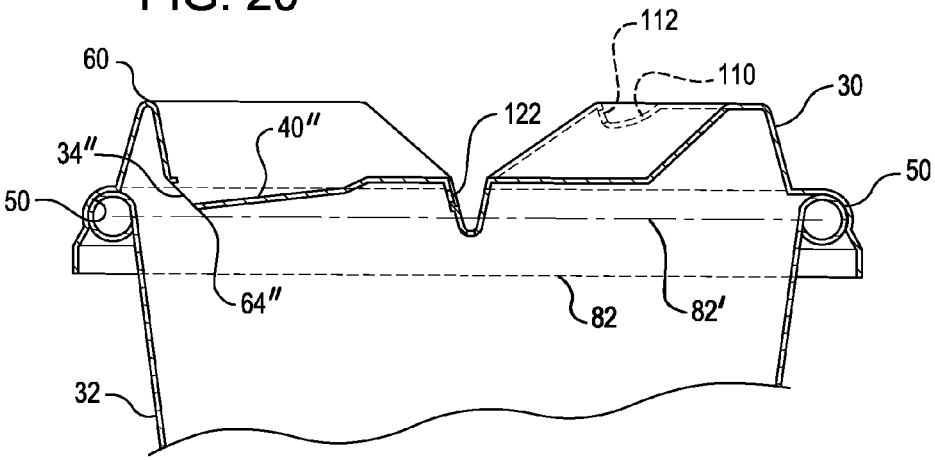
FIG. 20 is a partial cross-sectional view of a design for a disposable lid, showing an embodiment wherein the lower end of the floor of a drink well base is located at a level above the centerline of the interior bead sealing portion of the lid.

Attention is directed to FIGS. 18, 19, and 20, wherein different embodiments for the shape and size of a drink well base are provided. In FIG. 18, a drink well base 40 is provided having a peripheral side 64 that ends at a vertical level at or about the centerline 82' of the interior bead sealing portion 50, and a drink outlet 34 is provided. In an embodiment the centerline 82' may be parallel to a plane 82 defined by the bottom edge of an annular flanged rim 46. In FIG. 19, a drink well base 40' is provided having a peripheral side 64' that ends at a vertical level well below the centerline 82' of the interior bead sealing portion 50, and a drink outlet 34' is provided. In such an embodiment, the peripheral side 64' of the drink well base 40' should be no further than zero point five (0.5) inches (1.27 cm) below the centerline 82' of the interior bead sealing portion 50. In FIG. 20, a drink well base 40" is provided having a peripheral side 64" that ends at a vertical level above the centerline 82' of the interior bead sealing portion 50, and a drink outlet 34" is provided.

Additionally, it may be noted that the volume of liquid necessary to fill the "wedge" shaped space in the drink well 40 below the user's lip may vary as the amount of liquid in the beverage cup varies. In various embodiments, a drink well may be sized and shaped to allow sufficient liquid to be contained therein so that the user can take satisfying slurps or drinks of different sizes.

As may be seen by reference to FIG. 21, in order to provide the above described advantages in a thermoformed drink-through lid, an embodiment has been developed in which minimizes the amount of liquid that may become trapped, during use, in a drink-through lid design having a hollow raised lip portion. In one aspect, this may be accomplished by minimizing, or at least optimizing, the distance between an inner sidewall 200 of the outer lip portion 56 of the hollow raised lip portion 54 and the radially outermost edge $R_O$ of a drink outlet 34. In another yet related aspect, this may be accomplished by minimizing, or at least optimizing, the generally horizontal distance between the inner sidewall of a beverage cup and an inside wall 202 of interior portion 62 of the hollow raised lip portion 54. In an embodiment, such dimensions may provided in combination with a drink well 40 that is sufficiently deep, and/or a hollow raised lip portion 54 that is sufficiently high, that liquid flowing into a drink well 40 from a drink outlet 34 does not immediately impact a user's lips, as the liquid emerges from drink outlet 34. In another aspect, there should be adequate space below the upper edge of the drink outlet 34 to allow a big enough pool of liquid to form in the drink well 40 to create a natural, open top cup like drinking experience. Thus, in an embodiment, by (a) extending the outer lip portion 60 of the hollow raised lip portion 54 outward, to allow for both a drink outlet 34 and space for a user's lips above a liquid level in a drink well 40, (b) by making the interior portion 62 of the hollow raised lip portion 54 of a beverage cup 30 or 130 rather steep (downward, and in some embodiments, slightly inwardly sloping) but still in a manufacturable configuration for a thermoforming processes, and (c) by providing a drink outlet 34 that at least in part extends upward into the interior portion 62 of hollow raised lip portion 54, a novel drink-through lid design has been provided. With respect to dimensions $D_1$, $D_2$, and $D_3$, as indicated in FIG. 21, those of skill in the art will understand that such dimensions will vary depending upon the size of a beverage container 32 on which the lid 30 is to be placed, as in many retail stores selling hot and cold beverages, sizes such as small, medium, and large (or for example, tall, grande, and vente) may be provided, with similar or differing dimensions, depending on the policy of a particular retail store.

Figure 23:
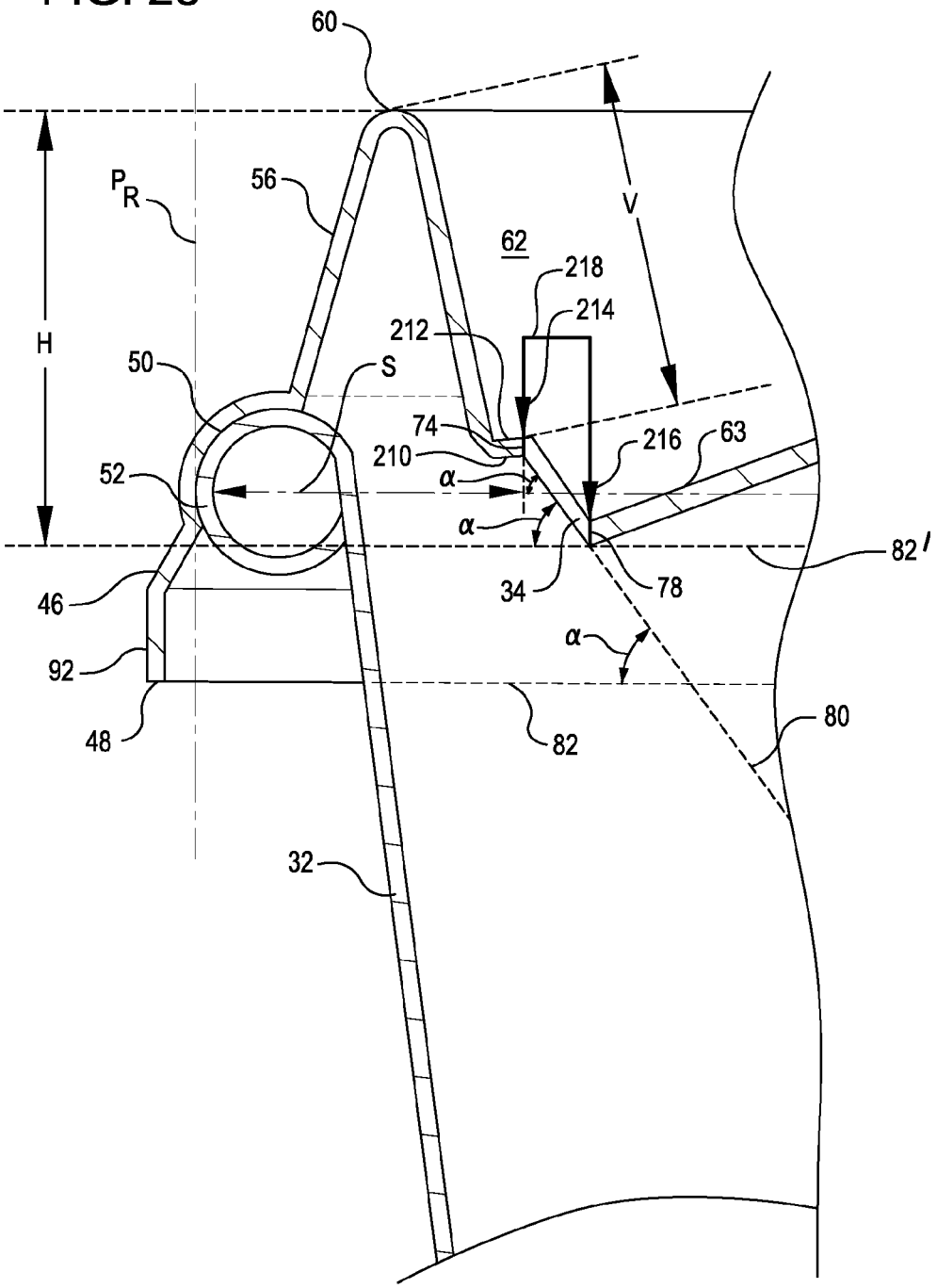
FIG. 23 is a partial cross-sectional view of a design for a disposable lid, showing in detail the features of construction for an embodiment wherein a shoulder ledge is provided extending outward from the interior portion of the hollow raised lip portion, to present a surface to facilitate cutting, such as by use of downwardly directed die cutter, to remove thermoformed material, and to form the edges of a drink outlet.

Attention is now directed to FIG. 23, wherein further details for structure of an exemplary drink through lid 30 are provided, at a scale which enables better visualization of a suitable method for fabrication of such drink-through lids 30. Drink-through lid 30 is partially depicted, showing the interior bead sealing portion 50 in place in a snap fit fashion (see interference dimension $D_2$ in FIG. 21) over a bead 52 of a beverage cup 32. For ease of manufacturing, lid 30 may be provided with an inwardly protruding shoulder 210, of a predetermined width along top face 212. In an embodiment the width along top face 212 may be about one tenth of an inch (0.1") (0.254 cm), or less. As seen by reference arrows 214 and 216, and connected by line 218 as if provided by a cutting die, a cut made, for example, by use of a vertically moving hardened metallic die downward along planes represented at reference arrows 214 and 216, can be utilized to remove excess thermoplastic material and thus define edges to provide drink outlets 34. Such stamping of drink through openings is a known practice subsequent to vacuum forming of thermoplastic material. However, the present design simplifies the manufacturing process for a drink-through lid, by use of the inwardly protruding shoulder 210, so that the thickness of a necessary cut through thermoplastic material is minimized. By provision of an inwardly protruding shoulder 210, the full benefit of the design provided herein can be easily realized, and yet such lids can be produced in large scale manufacturing operations.

It should also be noted in FIG. 23 that an angle alpha ($\alpha$) is indicated, for example, as between plane 82 and the plane 80 as noted for the orientation, in an embodiment, of drink outlet 34. Although the location of angle alpha ($\alpha$) is slightly offset when the inwardly protruding shoulder 210 is utilized, the reader should refer to the discussion set forth elsewhere herein as regards the particulars of such angle alpha ($\alpha$).

Figure 24:
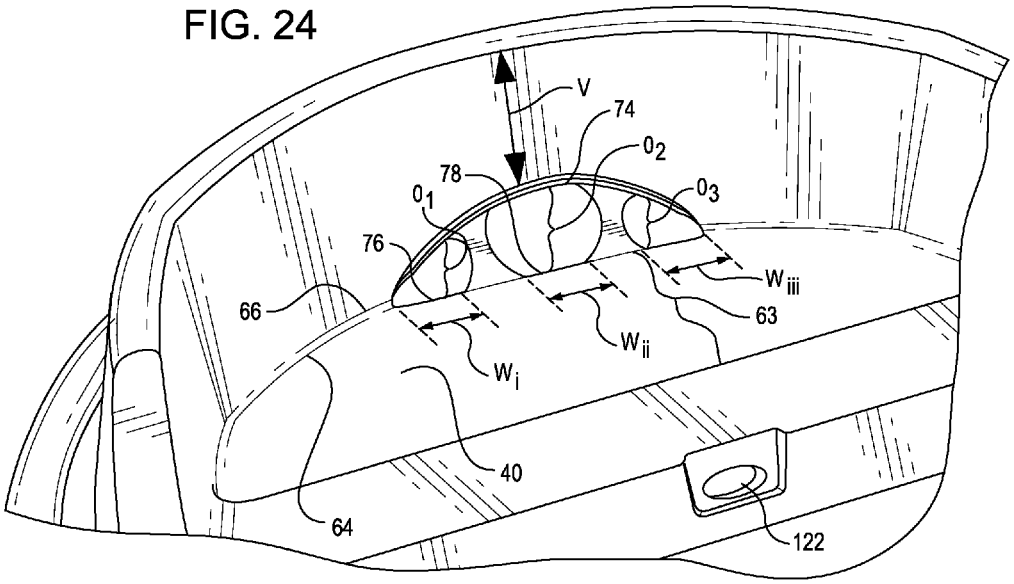
FIG. 24 provides a partial perspective view of a drink-through lid for a cup, having a drink well base into which liquid emerges for consumption, and which also reveals the use of a plurality of drink outlets for passage of liquid to the drink well base.

Next, attention is directed to FIG. 24, wherein an embodiment that includes a series of drink outlets from $O_1$, through $O_N$, wherein N is a positive integer. As a further example a series of drink outlets 34 may be provided in a series of drink outlets from $O_1$, $O_2$, $O_3$, $O_{N-1}$, through $O_N$, wherein in N is a positive integer. In FIG. 24, drink outlets $O_1$, $O_2$, $O_3$, are provided. Associated with each of the drink outlets $O_1$, $O_2$, $O_3$, $O_{N-1}$, through $O_N$, wherein in N is a positive integer, for example are a plurality of segments of $W_1$ comprising $W_i$, $W_{ii}$, $W_{iii}$, $W_{N-1}$, $W_n$, wherein n is a positive integer. Also seen in FIG. 24 is the use of a vent passageway 122 which has an oval outlet shape.

Figure 25:
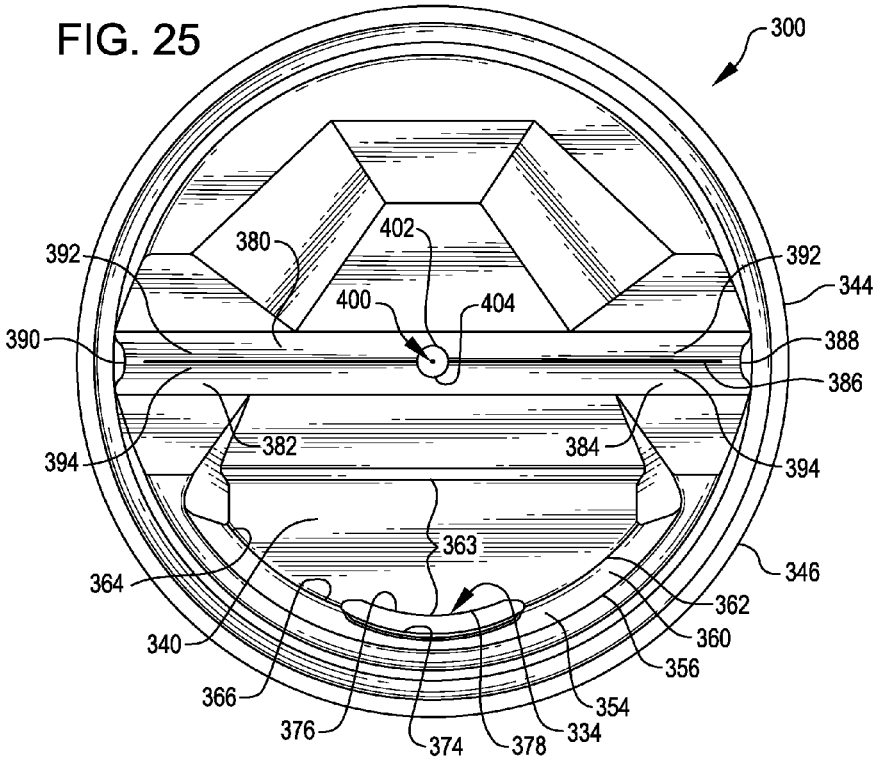
FIG. 25 provides a top plan view of an embodiment for a drink-through lid for a cup, showing a drink well base into which liquid emerges for consumption, and which also reveals a downwardly protruding slit in which first and second vent portions are provided for flow of vapors through the lid.
Figure 26:
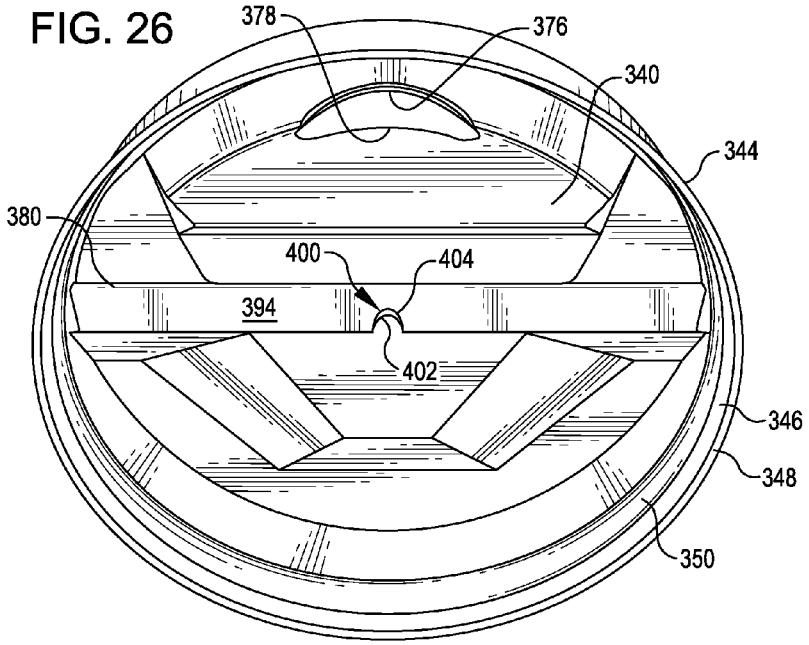
FIG. 26 provides a perspective view looking upward at an embodiment for a drink-through lid for a cup, showing, extending downward, a drink well base into which liquid emerges for consumption, and which also reveals first and second downwardly protruding members which form a slit in which first and second vent portions are provided for flow of vapors through the lid.

Attention is now directed to FIGS. 25 and 26, which illustrate an embodiment for a drink-through lid for a cup 300. FIG. 25 provides a top view, taken looking down at the lid 300, and FIG. 26 provides a bottom perspective, looking up at the lower side of the lid 300. As seen in FIG. 26, lid 300 has a base 344 with rim 346 having a bottom edge 348, and an interior bead sealing portion 350. In an embodiment, rim 346 may be annular in shape. The base 344 is sized and shaped to sealingly engage an open end of beverage container (not shown in this figure, but often circular), which may be defined by a bead on the beverage container, in the manner described above. A hollow raised lip portion 354 is provided, and it has an exterior portion 356 extending upwardly from the drink well base 340, an outer lip portion 360, and an interior portion 362 sloping downwardly and inwardly from the outer lip portion 360 to lower end portions 366. A drink well base 340 for containing liquid (see FIG. 3) is provided. The drink well base 340 has a floor 363 extending from a peripheral side 364 along at least some of the lower end portions 366. At least one drink outlet 334 is provided. The at least one drink outlet 334 may be defined by a first edgewall 374 extending upward into the interior portion 362 of the hollow raised lip portion 354 and by an elongated second edgewall 376 extending along an outlet portion 378 of the drink well base 340 in proximity to the peripheral side 64.

As seen in FIG. 25, the drink-through lid 300 may include a downwardly extending wall 380 that extends transversely across the drink-through lid 300. In an embodiment, a trough shaped wall 380 may be provided, as in a downwardly directed V-shape or U-shape. In an embodiment, the trough shaped wall 380 may be provided in a chord like configuration. In an embodiment, the trough shaped wall 380 may be provided with first 382 and second 384 portions extending out radially. In an embodiment, such radially extending portions may be aligned as if in a partial chord line (extending in a chord like direction but not extending all the way to the edges of the base 344) with respect to a circular shaped base 344.

In an embodiment, a slit 386 may be provided between a first end 388 and a second end 390, and along a first edge 392 and a second edge 394 formed by wall 380. Also, an opening 400 may be provided in wall 380 as defined by first edgewall 402 in first edge 392 to define a first vent portion, and a second edgewall 404 in second edge 394 that defines a second vent portion. Together, the first vent portion and second vent portion, as provided by first edgewall 402 and second edgewall 404 in wall 380, allow for flow of vapors through the lid.

Various embodiments may be provided using various types of plastics, such as thermoplastics. In various embodiments, the combination of a lid and beverage cup may be disposable, in that they are intended only for a single use. For such uses, very inexpensive thermoplastic materials may be suitable for construction of the lids 30. And, in such uses, a disposable baffle 150 manufactured in paper or paperboard may be utilized. Other than the exemplary structural techniques just taught above for facilitating manufacture of lid designs 30 as taught herein, the processes for manufacturing such goods are well known in the art, and thus will not be further explained herein. However, those skilled in the art will recognize that various embodiments may be manufactured using other processes, and consequently, the invention is not limited to any particular method of manufacture.

In the foregoing description, for purposes of explanation, numerous details have been set forth in order to provide a thorough understanding of the disclosed exemplary embodiments for the design of a disposable lid for use in combination with a beverage container that will provide a more natural drinking experience, and for an enhanced disposable lid that further includes and enables use of a disposable baffle to assure that aroma reaches the nose of the drinker. However, certain of the described details may not be required in order to provide useful embodiments, or to practice selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the present invention. However, the order of description should not be construed as to imply that such activities are necessarily order dependent. In particular, certain operations may not necessarily need to be performed precisely in the order of presentation. And, in different embodiments of the invention, one or more activities may be performed simultaneously, or eliminated in part or in whole while other activities may be added. Also, the reader will note that the phrase "in an embodiment" or "in one embodiment"

has been used repeatedly. This phrase generally does not refer to the same embodiment; however, it may. Finally, the terms "comprising", "having" and "including" should be considered synonymous, unless the context dictates otherwise.

From the foregoing, it can be understood by persons skilled in the art that a novel beverage container lid, and a novel baffle for use with a beverage container lid, have been described herein. Although only certain specific embodiments of the present invention have been shown and described, there is no intent to limit this invention by these embodiments. Rather, the invention is to be defined by the appended claims and their equivalents when taken in combination with the description.

Importantly, the aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive or limiting. As such, this disclosure is intended to cover the structures described herein and not only structural equivalents thereof, but also equivalent structures.

Numerous modifications and variations are possible in light of the above teachings. Therefore, the protection afforded to this invention should be limited only by the claims set forth herein, and the legal equivalents thereof.

I claim:

1. A drink-through lid for a beverage cup having an open end, comprising: a thermoformed plastic structure, comprising a base having a rim having a bottom edge, and an interior bead sealing portion, said base sized and shaped to sealingly engage the open end of the beverage cup; a hollow raised lip portion having an exterior portion extending upwardly from said base, a outer lip portion, and an interior portion sloping downwardly from said outer lip portion to lower end portions; a drink well base having a floor extending from a peripheral side adjacent said lower end portions, the drink well base located below said outer lip portion; and at least one drink outlet, said at least one drink outlet defined by a first edgewall provided by an inwardly protruding shoulder from said interior portion of said hollow raised lip portion, said first edgewall extending upward into said interior portion of said hollow raised lip portion, and by an elongated second edgewall extending along an outlet portion of said drink well base in proximity to said peripheral side, said at least one drink outlet oriented substantially as if along a first surface extending from said elongated second edgewall at an angle alpha ($\alpha$) in the range of from about forty degrees (40°) to about ninety degrees (90°).

2. A drink-through lid as set forth in claim 1, wherein said first surface comprises a planar surface.

3. A drink-through lid as set forth in claim 1, wherein said at least one drink outlet is oriented at least in part as if along a second surface extending outward from said outlet portion of said drink well base.

4. A drink-through lid as set forth in claim 3, wherein said second surface comprises a planar surface.

5. A drink-through lid as set forth in claim 3, wherein said elongated second edgewall of said at least one drink outlet and said outlet portion of said drink well base are contiguous along a width $W_1$.

6. A drink-through lid as set forth in claim 5, wherein said width $W_1$ is less than or equal to about two (2) inches (about 5.08 cm).

7. A drink-through lid as set forth in claim 5, wherein said width $W_1$ is about one (1) inch (2.54 cm), plus or minus about fifty percent (50%).

8. A drink-through lid as set forth in claim 5, wherein said width $W_1$ is about one (1) inch (2.54 cm), plus or minus about twenty five percent (25%).

9. A drink-through lid as set forth in claim 5, wherein said elongated second edgewall of said at least one drink outlet is provided in a generally straight line.

10. A drink-through lid as set forth in claim 5, wherein said elongated second edgewall of said at least one drink outlet is provided in an outwardly bowed shape.

11. A drink-through lid as set forth in claim 5, wherein said at least one drink outlet comprises a plurality of drink outlets in a series of drink outlets from $O_1$, through $O_N$, wherein N is a positive integer.

12. A drink-through lid as set forth in claim 11, wherein associated with each of said at least one drink outlet in said series of drink outlets from $O_1$, through $O_N$, wherein N is a positive integer, said width W1 comprises a plurality of segments of width Wi through Wn, wherein n is a positive integer.

13. A drink-through lid as set forth in claim 1, wherein said interior portion of said hollow raised lip portion slopes inwardly from said outer lip portion toward said lower end portions.

14. A drink-through lid as set forth in claim 1, wherein the open end of the beverage cup is circumscribed by a bead, and wherein said interior bead sealing portion of said drink-through lid is sized and shaped to sealingly and securely engage said bead.

15. A drink-through lid as set forth in claim 1, wherein said angle alpha ($\alpha$) is in the range of from about fifty degrees (50°) to about seventy degrees (70°).

16. A drink-through lid as set forth in claim 1, wherein said angle alpha ($\alpha$) is about sixty degrees (60°).

17. A drink-through lid as set forth in claim 1, wherein said interior portion of said hollow raised lip portion slopes downwardly and inwardly at an angle beta ($\beta$) in the range of from about seventy degrees (70°) to about eighty five degrees (85°).

18. A drink-through lid as set forth in claim 1, wherein said rim has an outer edge, and wherein said elongated second edgewall of said drink-through opening is defined along a line a distance $L_1$ from a line tangent to the outer edge of the rim, and wherein the line tangent to an outer edge of the rim is orthogonal to a line having an opposing end centered with respect to said drink outlet.

19. A drink-through lid as set forth in claim 5, wherein said elongated second edgewall is parallel to a line tangent to an outer edge of the rim.

20. A drink-through lid as set forth in claim 1, wherein said first surface of said drink outlet is spaced apart from, but adjacent to, said interior bead sealing portion, so that the drink outlet is filled with liquid promptly when a beverage cup utilizing the drink-through lid is turned from a vertical position.

21. A drink-through lid as defined in claim 20, wherein a radially outermost edge Ro of said drink outlet is a distance S of about three tenths of an inch (0.3 inches) (0.762 cm), or less, from a reference plane $P_R$ at said interior bead sealing portion.

22. A drink-through lid as set forth in claim 1 wherein a height H of said outer lip portion of said raised hollow raised lip portion is in the range of from about four-tenths of an inch (0.4 inches) (1.02 cm) to about nine-tenths of an inch (0.9 inches) (2.29 cm) above a radially innermost edge RI of said at least one drink outlet.

23. A drink-through lid as set forth in claim 1 wherein a vertical surface distance V of said interior portion of said hollow raised lip portion is in the range of from about zero point two four (0.24) inches (0.61 cm) to about zero point six nine (0.69) inches (1.753 cm).

24. A drink-through lid as set forth in claim 1, wherein said one or more drink outlets define a total open area in the range of from about zero point zero six (0.06) square inches (0.387 square centimeters) to about zero point two five (0.25) square inches (1.613 square centimeters).

25. A drink-through lid as set forth in claim 1, wherein said one or more drink outlets define a total open area in the range of from about zero point zero seven five (0.075) square inches (0.4838 square centimeters) to about zero point two (0.2) square inches (1.2903 square centimeters).

26. A drink-through lid as set forth in claim 1, wherein said one or more drink outlets define a total open area in the range of from about zero point one three (0.13) square inches (0.8387 square centimeters) to about zero point two (0.2) square inches (1.2903 square centimeters).

27. A drink-through lid as set forth in claim 1, wherein said one or more drink outlets define a total open area of about zero point two (0.2) square inches (1.2903 square centimeters), or less.

28. A drink-through lid as set forth in claim 1, wherein said drink well base is sized and shaped to contain a selected liquid volume LV.

29. A drink-through lid as set forth in claim 28, wherein said liquid volume LV is about zero point one six (0.16) fluid ounces (4.73 milliliters), or more.

30. A drink-through lid as set forth in claim 1, wherein said peripheral side of said drink well base is vertically located at about said bottom edge of said rim.

31. A drink-through lid as set forth in claim 1, wherein said peripheral side of said drink well base is vertically located above said bottom edge of said rim.

32. A drink-through lid as set forth in claim 1, wherein said interior bead sealing portion is located along a bead centerline, and wherein said peripheral side of said drink well base is vertically located at about said bead centerline of said interior bead sealing portion.

33. A drink-through lid as set forth in claim 1, wherein said interior bead sealing portion is located along a bead centerline, and wherein said peripheral side of said drink well base is vertically located above said bead centerline of said interior bead sealing portion.

34. A drink-through lid as set forth in claim 1, wherein said first edgewall of said drink outlet is arcuately shaped.

35. A drink through lid as set forth in claim 1, wherein said elongated second edgewall of said drink outlet is linear in shape.

36. A drink-through lid as set forth in claim 1, wherein said drink-through lid comprises thermoplastic material.

37. A drink-through lid as set forth in claim 1, wherein at least zero point zero six (0.06) square inches (0.3870 square centimeters) of total area is provided in said one or more drink outlets within zero point five (0.5) inches (1.27 cm) radially inward from a reference plane $P_R$ located at said interior bead sealing portion.

38. A drink-through lid as set forth in claim 1, wherein total open area provided by all of said one or more drink outlets is located between a reference plane $P_R$ located at said interior bead sealing portion and a location not more than zero point five (0.5) inches (1.27 cm) radially inward therefrom.

39. A drink-through lid as set forth in claim 1, wherein at least some open area of said one or more drink outlets is located between a reference plane $P_R$ located at said interior bead sealing portion and a location not more than zero point four (0.4) inches (1.016 cm) radially inward therefrom.

40. A drink-through lid as set forth in claim 1, further comprising a vapor dome, said vapor dome comprising a raised sidewall extending upwardly from said base and arcuately between first and second sidewall ends, and an interior vapor dome wall having an upper end and a lower end and extending across said lid from said first to said second sidewall ends, and a vapor dome face extending between said raised sidewall and said upper end.

41. A drink-through lid as set forth in claim 40, wherein said vapor dome face further comprises at least one vapor vent well, said vapor vent well having at least one vapor-directing passageway therein.

42. A drink-through lid as set forth in claim 41, wherein said vapor dome face comprises two vapor vent wells.

43. A drink-through lid as set forth in claim 1, wherein said lid further comprises a downwardly extending trough shaped wall extending across said drink-through lid.

44. A drink-through lid as set forth in claim 43, further comprising one or more vapor passageways through said downwardly extending trough shaped wall.

45. A drink-through lid as set forth in claim 44, wherein said one or more vapor passageways have an oval outlet shape.

46. A drink-through lid as set forth in claim 44, wherein at least one of said one or more vapor passageways is oriented to project vapors initially in a direction that is predominantly horizontal in relation a plane along a centerline of said interior bead sealing portion.

47. A drink-through lid as set forth in claim 1, further comprising:

a downwardly extending trough shaped wall extending across said drink-through lid, and a slit of length LS formed along a partial chord line with respect to said base, said slit provided between first and second ends, and along a first edge and a second edge formed by said downwardly extending tough shaped wall.

48. A drink-through lid as set forth in claim 44, or in claim 47, wherein said downwardly extending trough shaped wall comprises a V-shaped wall.

49. A drink-through lid as set-forth in claim 44, or in claim 47, wherein said downwardly extending trough shaped wall comprises a U-shaped wall.

50. A drink-through lid as set forth in claim 47, further comprising one or more vapor passageways through said downwardly extending trough shaped wall.

51. A drink-through lid as set forth in claim 1, further comprising:

a downwardly extending trough shaped wall extending across said drink-through lid;

a slit of length LS between first and second ends, formed along first and second radially extending portions, along a first edge and a second edge formed by said downwardly extending trough shaped wall; and an opening located between said first and second radially extending portions, said opening defined by a first edgewall in said first edge and a second edgewall in said second edge, said first edgewall defining a first vent portion and said second edgewall defining a second vent portion, said first vent portion and said second vent portion providing said opening, wherein said opening allows flow of vapors through said lid.

52. A drink-through lid as set forth in claim 47, further comprising a baffle, said baffle provided in a generally trapezoidal shaped configuration having an overall width WB complementary to slit length LS, adapted for insertion downward through said slit.

53. A drink-through lid as set forth in claim 52, wherein said slit forms a first stable condition wherein said first edge and said second edge are urged together to substantially prevent liquid leakage therethrough, and a second stable condition wherein said first edge and said second edge are urged toward said baffle, to substantially prevent liquid leakage.

54. A drink-through lid as set forth in claim 52, wherein said baffle further comprises edge locks, said edge locks sized and shaped for locking engagement with first and second ends of said slit.

55. A drink-through lid as set forth in claim 54, wherein said edge locks comprise notches in said baffle.

56. A drink-through lid as set forth in claim 52, wherein said baffle comprises a lower end, and wherein said lower end includes an upwardly extending lower baffle wall, said lower baffle wall defining, in combination with said beverage cup, a liquid passageway.

57. A drink-through lid as set forth in claim 52 for use with a beverage container having inner sidewalls generally frusto-conical in shape, and wherein said baffle comprises a first side and a second side complementary in shape and sized for sealing engagement with the beverage cup inner sidewalls.

58. A drink-through lid as set forth in claim 57, wherein said baffle effectively divides the beverage cup into at least a first chamber and a second chamber, said baffle shaped and positioned to allow liquid in said beverage container to flow freely between each of said chambers, said baffle effectively sealed with said drink-through lid at said slit, and positioned to prevent vapor within said first chamber that is between said drink-through lid and liquid in said beverage cup from flowing to said second chamber.

59. A drink-through lid as set forth in claim 58, wherein said drink-through lid comprises, associated with each of said chambers, one or more of (a) said at least one vapor-directing passageways, or (b) said at least one vapor passageway.

60. A drink-through lid as set forth in claim 59, wherein said vapor-directing passageways and said vapor passageways are disposed on either side of said baffle, so that when said beverage cup contains liquid and is tipped to allow liquid to flow out of said drink outlet, vapor within said first chamber is forced out of one or more of said at least one vapor passageways, while air outside of said beverage cup is simultaneously drawn into said second chamber through one or more of said at least one vapor-directing passageways.

61. A drink-through lid for a beverage cup having a circular opening, comprising: a thermoformed plastic structure, comprising a base comprising a rim having an interior bead sealing portion, said base sized and shaped to sealingly engage the circular opening of the beverage cup; a hollow raised lip portion comprising an exterior portion extending upwardly from said base, an outer lip portion, and an interior portion sloping downwardly from upper end portions at said outer lip portion, to lower end portions; a drink well base having a floor extending inwardly from at least some of said lower end portions, a low point in said floor providing a liquid drain located a height H below said outer lip portion; and at least one drink outlet, said at least one drink outlet defined by a first edgewall provided by an inwardly protruding shoulder from said interior portion of said hollow raised lip portion, said first edgewall extending upward into said interior portion of said hollow raised lip portion, and by an elongated second edgewall extending along an outlet portion of said drink well base, said at least one drink outlet oriented at least in part as if along a first surface extending from said first edgewall at an average angle alpha ($\alpha$) in the range of from about forty degrees (40°) to about ninety degrees (90°).

62. A drink-through lid as set forth in claim 61 wherein said height H is in the range of from about four-tenths of an inch (0.4 inches) (1.016 cm) to about nine-tenths of an inch (0.9 inches) (2.286 cm).

63. The drink-through lid as set forth in claim 62, wherein said interior portion of said hollow raised lip portion slopes downwardly and inwardly at an angle beta ($\beta$) in the range of from about seventy degrees (70°) to about ninety degrees (90°).

64. The drink-through lid as set forth in claim 62, wherein said first surface comprises a planar surface.

65. The drink-through lid as set forth in claim 62, wherein said at least one drink outlet is oriented at least in part along a second surface extending outwardly from said floor of said drink well base.

66. The drink-through lid as set forth in claim 65, wherein said second surface comprises a planar surface.

67. A drink-through lid as set forth in claim 1 or claim 61, wherein said floor of said drink well base slopes downward, at least in part, in a radially outward direction.

68. A drink-through lid as set forth in claim 61, wherein said angle alpha ($\alpha$) is in the range of from about fifty degrees (50°) to about seventy degrees (70°).

69. A drink-through lid as set forth in claim 61, wherein said angle alpha ($\alpha$) is about sixty degrees (60°).

70. A drink-through lid for a beverage cup having a circular opening, comprising: a thermoformed plastic structure, comprising a base comprising a rim having an interior bead sealing portion, said base sized and shaped to sealingly engage the circular opening of the beverage cup; a hollow raised lip portion comprising an exterior portion extending upwardly from said base, an outer lip portion, and an interior portion sloping downwardly from upper end portions at said outer lip portion, to lower end portions; a drink well base having a floor extending inwardly from at least some of said lower end portions, a low point in said floor providing a liquid drain located a height H in the range of from about four-tenths of an inch (0.4 inches) (1.016 cm) to about nine-tenths of an inch (0.9 inches) (2.286 cm) below said outer lip portion; and at least one drink outlet, said at least one drink outlet defined by a first edgewall provided by an inwardly protruding shoulder from said interior portion of said hollow raised lip portion, said first edgewall extending upward into said interior portion of said hollow raised lip portion, and by an elongated second edgewall extending along an outlet portion of said drink well base, said at least one drink outlet oriented at least in part as if along a first surface extending from said first edgewall at an average angle alpha ($\alpha$) in the range of from about forty degrees (40°) to about ninety degrees (90°), said at least one drink outlet having an open area of at least zero point zero five (0.05) square inches (0.3226 square centimeters) within zero point five (0.5) inches (1.27 cm) radially inward from a reference plan $P_R$ located at said interior bead sealing portion, and wherein said first edgewall of said at least one drink outlet is located a distance V of at least zero point four (0.4) inches (1.016 cm) from said outer lip portion.

71. A drink-through lid as set forth in claim 61 or in claim 70, further comprising:

a downwardly extending v-shaped wall extending across said drink-through lid, and a slit of length LS formed along a partial chord line with respect to said base, said slit provided between first and second ends, and along a first edge and a second edge formed by said v-shaped wall.

72. A drink-through lid as set forth in claim 71 further comprising one or more vapor passageways through said v-shaped wall.

73. A drink-through lid as set forth in claim 72, wherein at least one of said one or more vapor passageways is oriented to project vapors initially in a direction that is predominantly horizontal in relation a plane along a centerline of said interior bead sealing portion.

* * * * *